US012768581B2

(12) United States Patent
Haider

(10) Patent No.: US 12,768,581 B2
(45) Date of Patent: Oct. 20, 2026

(54) ICE PRODUCTION INSERT

(71) Applicant: Klaris, Inc., Minneapolis, MN (US)

(72) Inventor: Charles Haider, St. Paul, MN (US)

(73) Assignee: Klaris, Inc., Minneapolis, MN (US)

( * ) Notice: Subject to any disclaimer, the term of this patent is extended or adjusted under 35 U.S.C. 154(b) by 252 days.

(21) Appl. No.: 18/393,950

(22) Filed: Dec. 22, 2023

(65) Prior Publication Data

US 2024/0125533 A1 Apr. 18, 2024

Related U.S. Application Data

(63) Continuation-in-part of application No. 17/497,431, filed on Oct. 8, 2021, now abandoned.

(60) Provisional application No. 63/436,131, filed on Dec. 30, 2022, provisional application No. 63/110,611, filed on Nov. 6, 2020.

(51) Int. Cl.
*F25C 1/243* (2018.01)
*F25C 1/18* (2006.01)

(52) U.S. Cl.
CPC ..... *F25C 1/243* (2013.01); *F25C 1/18* (2013.01)

(58) Field of Classification Search
CPC ..... F25C 1/04; F25C 1/12; F25C 1/18; F25C 1/20; F25C 1/22; F25C 1/24; F25C 1/243; F25C 1/246; F25C 2400/06
USPC ..... 62/3.63
See application file for complete search history.

(56) References Cited

U.S. PATENT DOCUMENTS 2,614,399 A * 10/1952 Roethel ..... F25C 1/24 220/23.88
3,020,730 A * 2/1962 Harris, Sr. ..... F25C 1/18 62/307
3,318,105 A 5/1967 Burroughs et al.
3,684,234 A 8/1972 Cinebell
5,364,063 A 11/1994 Nishimura et al.
(Continued)

FOREIGN PATENT DOCUMENTS

CN 111854250 A * 10/2020 ..... F25C 1/24
CN 111854251 A * 10/2020 ..... F25C 1/18
(Continued)

OTHER PUBLICATIONS

WO-2016013730-A1 English Translation (Year: 2016).*
CN-111854251-A English Translation (Year: 2020).*
CN-111854250-A English Translation (Year: 2020).*

*Primary Examiner* — Frantz F Jules
*Assistant Examiner* — Devon Moore
(74) *Attorney, Agent, or Firm* — Danielson Legal LLC

(57) ABSTRACT

An ice machine, tray, and tray insert are provided. A heat exchanger cools the liquid to freezing, then overcomes the heat of fusion to form ice. The tray includes an energy transfer surface in thermal contact with the heat exchanger to define a liquid/ice boundary layer. The tray further includes at least one freezing cavity. An egress area is defined in the tray above the freezing cavity. An insert traps a small volume of liquid, thus hindering movement of the liquid underneath the inserts and providing a nucleation/seed site. A mixing mechanism displaces the liquid thereby causing the liquid to flow to create a velocity profile at the liquid/ice boundary layer to create a directional freezing process starting from the energy transfer surface of the tray in thermal contact with the heat exchanger and growing through the freezing cavity up to the egress area.

21 Claims, 24 Drawing Sheets

(56) References Cited

U.S. PATENT DOCUMENTS

| | | | | |
|---|---|---|---|---|
| 9,074,802 | B2 | 7/2015 | Culley et al. | |
| 9,151,527 | B2 | 10/2015 | Boarman et al. | |
| 9,272,444 | B2 | 3/2016 | Zorovich et al. | |
| 9,651,290 | B2 | 5/2017 | Boarman et al. | |
| 9,719,720 | B2 | 8/2017 | Seo et al. | |
| 9,784,492 | B2 | 10/2017 | Little et al. | |
| 9,863,683 | B2 * | 1/2018 | Baumbach | F25C 1/24 |
| 10,378,806 | B2 | 8/2019 | Boarman et al. | |
| 10,443,915 | B2 | 10/2019 | Little et al. | |
| 10,670,317 | B2 | 6/2020 | Wu | |
| 11,747,067 | B2 * | 9/2023 | Moczygemba | F25C 5/08 62/73 |
| 2004/0025527 | A1 | 2/2004 | Takahashi et al. | |
| 2009/0152438 | A1 | 6/2009 | Chu | |
| 2010/0071400 | A1 | 3/2010 | Feinauer et al. | |
| 2011/0061421 | A1 | 3/2011 | Stewart et al. | |
| 2017/0038112 | A1 | 2/2017 | Papalia | |
| 2017/0299244 | A1 | 10/2017 | Alshourbagy et al. | |
| 2018/0335238 | A1 | 11/2018 | Denigan, III et al. | |
| 2019/0120534 | A1 | 4/2019 | Chandrashekarin et al. | |
| 2019/0360736 | A1 | 11/2019 | Du Plessis et al. | |
| 2020/0064043 | A1 | 2/2020 | Larson et al. | |
| 2020/0318884 | A1 | 10/2020 | Recine et al. | |
| 2023/0366602 | A1 * | 11/2023 | Hays | F25C 1/04 |

FOREIGN PATENT DOCUMENTS

| | | | | |
|---|---|---|---|---|
| FR | 2688874 | A1 | 9/1993 | |
| WO | WO-2016013730 | A1 * | 1/2016 | F25C 5/18 |
| WO | WO2017/216294 | | 12/2017 | |

* cited by examiner

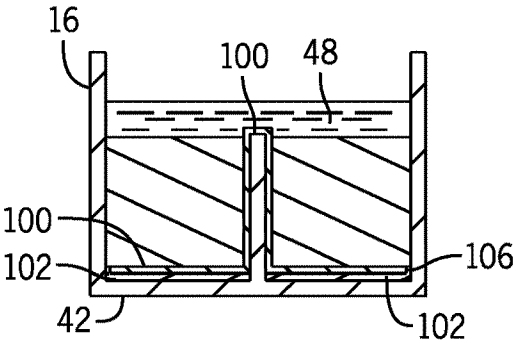
FIG. 18A
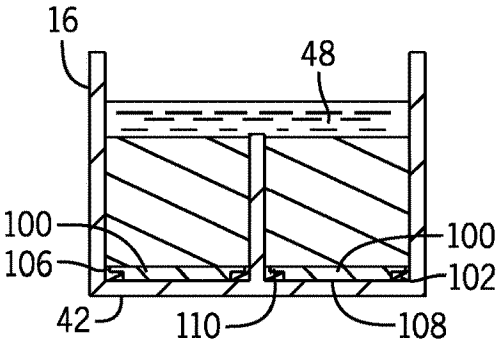
FIG. 18B
FIG. 18C
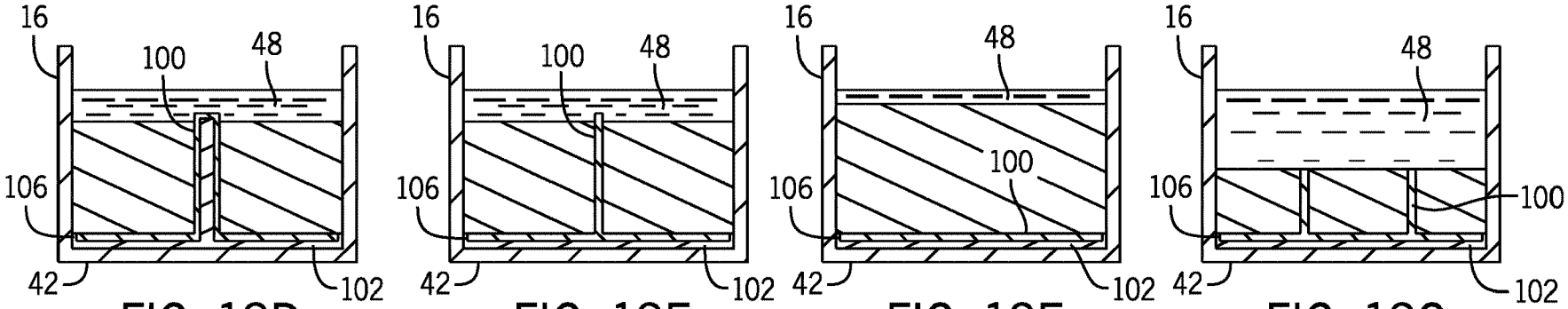
FIG. 18D
FIG. 18E
FIG. 18F
FIG. 18G

ICE PRODUCTION INSERT

CROSS-REFERENCE TO RELATED APPLICATIONS

This utility patent application claims the benefit of and priority to U.S. Provisional Patent Application No. 63/436,131, filed 30 Dec. 2022, also entitled "Ice Production Insert" and is a continuation-in-part of U.S. patent application Ser. No. 17/497,431, filed 8 Oct. 2021, entitled "Systems and Methods for Producing Ice", which claims the benefit of and priority to U.S. Provisional Patent Application No. 63/110,611, filed 6 Nov. 2020, also entitled "Systems and Methods for Producing Ice", the contents all of which are hereby incorporated by this reference.

FIELD OF THE INVENTION

The present invention relates to high-quality ice making.

BACKGROUND OF THE INVENTION

There are many ice making technologies today that exist to create particular ice forms for specific market needs. Standard ice cubes are opaque and can melt quickly in beverages resulting in a warm drink with a watered-down taste. Large clear ice forms can ameliorate both problems. As used herein, the focus will be on technologies that aim to make substantially clear ice forms. Ice making technologies can be measured against key metrics, which include ice growth, ice shape/form, ice quality, machine price and size, and ease of use.

Ice growth rate (or throughput) as used herein is defined as the amount of ice production over a set period, usually specified in lbs./day. For larger ice forms, it may be advantageous to measure the rate of ice growth from the cooling surface at a particular time, which is usually specified in mm/min.

Ice shape/form as used herein is defined as the geometry of the final ice form relative to the negative geometry created by the mold. Depending on the process or hardware, shapes can change throughout the freezing process.

Ice quality (and/or purity and/or clarity) as used herein is defined as the amount of transparency, impurities such as total dissolved solids (TDS) and/or total dissolved gases (TDG) in the final ice form. Typically, transparency of the ice is indirectly proportional to the TDS and TDG concentrations (more transparent, less impurities) relative to the starting concentration.

Ice machine price and size as used herein can be roughly broken into several categories: low cost (<$50), e.g., fits in a consumer freezer; med cost (<$500), e.g., fits on countertop or in a consumer freezer; high cost ($500-2000), e.g. fits under a countertop or on a countertop; and industrial or other (>$2000), e.g. needs a dedicated space Ease of use (or user workflow or user experience) is more subjective, but this metric as used herein aims to measure the level of effort and investment (fixed and variable) to yield desired ice. This can include the number of people needed at any one time throughout the process, time from start to final ice form, number of unique steps in workflow, additional capital equipment to post process and/or deliver the ice to the customer, maintenance needed throughout the lifetime of the ice machine, and/or any consumables needed to make ice.

Crystal clear ice making devices available today produce clear ice primarily using one of three methods, each with their own drawbacks: One is the use of simple molds, made of silicone, other plastic, and/or metal. The use of simple molds has grown in popularity as a cheap and convenient method to create large ice forms. Simple molds work much like a regular ice tray, but just have substantially larger wells/cavities and typically are made from flexible material to enable removal. To use a simple mold, the user fills up the tray with tap water, carefully places the tray in their home freezer, removes the tray after 18-24 hours, then "pops" the ice out of the tray.

The main downfall of the use of simple molds is the quality of ice produced. Not only are the final ice forms not clear, but the low quality of the water put in results in a low quality of the ice that comes out. In addition, exposure of the top can result in freezer burn if left in too long without a cover. Simple molds also take up valuable freezer space, can easily be spilt when transferring into or closing the freezer, can create ice forms that are unsymmetrical due to inadequate wall thicknesses, and have slow and inconsistent growth rates since the freezing is beholden to the air temperature and performance of the refrigeration system. This solution does not deliver the premium ice and experience people deserve.

In an attempt to solve the ice quality issue with simple molds, more complex molds have been utilized. In general, these systems are made of three components: a five-sided shell made of insulation, a five-sided shell made of water tight plastic used as a water reservoir, and a mold, typically made of one or multiple flexible pieces of plastic. The user fills the water reservoir with tap water to a fixed height, then positions the mold into the cavity/water. The distance between the bottom of the mold and the bottom of the water reservoir is fixed, creating an area of water below the mold. Pass-through features (e.g. holes) are designed into the bottom (and sometimes top) of the mold to allow particulates and water to move from the mold to the reservoir. The user then transfers the assembly into the freezer and waits 18-30 hours to remove. Throughout this time, the water primarily freezes from the top (uninsulated area) down, allowing some crystal growth, pushing some of the TDS and TDG of the water in the mold into the sacrificial reservoir. Once complete, the user retrieves the assembly from the freezer, removes the mold, and "pops" out their ice.

Although ice can be created with better transparency and lower TDS/TDG than simple molds, ice made utilizing these complex molds takes longer to form, takes up significantly more room in the freezer, and can still exhibit freezer burn on top if not properly covered. Use of complex molds also makes ice harvesting cumbersome for the user. The user must guess the best time to remove the system from the freezer: If they remove it too soon, the ice may not be fully formed, and they have to start over; if they remove it too late, the water reservoir below the mold can freeze, making it difficult to remove the mold and ice below. In many instances customers have broken their assemblies during this process. Depending on the number of mold pieces and pass-through features, the final ice form can also have visible parting lines and gate marks. Although use of complex molds is relatively cheap and creates better ice than a simple mold, this attempted solution does not deliver the premium ice and experience people desire.

With both simple and complex molds, the quality of water used has been addressed in attempting to improve ice clarity. Attempts such as filtering water, heating/boiling water, degassing water, and many others have been tried; however, the same issues persist.

To attempt to solve convenience and ease of use problems, large appliance manufacturers have created automated solutions that live within a freezing portion of a consumer refrigerator. Here, water is plumbed into the back of the refrigerator and distributed to the ice making device. These devices selectively fill the tray with water. Over time, the water in the tray converts to ice. Using time and/or temperature, the system automatically removes the ice forms from the tray and dispenses the cubes into a storage container. Although the solution is convenient and requires little to no interaction by the user, there are some significant shortcomings. First, if a user just wants the ice making capabilities of system, they are required to purchase the whole refrigerator which is very large and expensive (industrial or other). Like the mold solutions, the growth rate relies on cold air to transfer energy out of the water, which leads to long ice growth times (18-30 hours).

These solutions also yield semi-transparent—but not completely clear—ice. The final shape also has parting line and gate marks. These ice machines also have the same drawbacks of the quality of the water placed in the tray will remain the same in the ice. Although storage can be convenient, the ice forms could sinter together, making them difficult to remove. The temperature at which a typical freezer is held at is also not ideal for clear ice. High thermal stress will be released if the ice is quickly removed and placed in a much warmer liquid. The openness of the storage container could also lead to freezer burn on the ice forms.

To solve the throughput and/or clarity issues, a wide variety of companies have leveraged the approach of flowing water over or into a cold plate with lots of wells/cavities. Solutions range from countertop, to undercounter, to stand alone units. These ice machines typically generate smaller ice forms no greater than one inch (two centimeters) in any one dimension. Most units use refrigeration systems which are energy efficient but can take up significant space. High throughput units, typically undercounter or stand alone, are a very expensive capital expense and typically require yearly service contracts. The average consumer typically has a countertop or undercounter solution. The countertop solutions are medium cost and take up a good amount of counter space while producing sub-par ice using water filled by the user. Undercounter units are less hands on; however, initial installation must be done by a trained professional.

An example of these are the Kold Draft undercounter and stand-alone ice machines available from Kold-Draft, 101 Corporate Woods Parkway, Vernon Hills, Illinois 60061. These ice making machines automatically make 1.25-inch (three centimeter) square cubes that are substantially clear. These are not meant for at home use due to size and cost (high to industrial range). Restaurants and bars use these as a medium between small ice form making machines and buying expensive ice forms from an ice distributor. Aside from cost and size being a deterrent to consumers, these ice machines also require yearly servicing and professional installation for water and purge lines. These particular techniques create symmetrical ice forms; however, the open face exhibits a dimple. Also, during the harvesting stage, the quick change from cold to hot can crack the ice.

Another example of these is the Forge Clear Ice Machine provided by Haier US Appliance Solutions, Inc., Corporation Trust Center, 1209 Orange Street, Wilmington, Delaware 19801. This ice making machine is also large and expensive, has low throughput and limited shape, and requires post processing. The user would also have to interact with the ice machine twice as much to yield the same amount of ice. The ice machine yields "gems" which have to be post processed with a hot press into a sphere.

To address ice clarity, form size, and throughput problem of the previously described technologies, the Clinbell block ice machine available from Clinebell Equipment Company, 890 Denver Avenue, Loveland, Colorado 80537 was created. To get to the final ice form, the user must first create the ice form, vacuum off the top layer of water, use a crane to remove the ice form from the ice machine, trim the sides and top of the ice form to make square (creates lots of waste), cut up the ice into the specified form using a band saw, place the new ice forms into storage, then ship the ice forms to their final destination.

Due to its cost, size, and user workflow, this ice machine typically does not exist on the same site as the ice consumption: This ice machine is typically purchased by ice distributors who create, cut, store, and ship the ice to the end user at a premium of $0.50 to $1.00 per two-inch (five centimeter) cube, a significant markup from the water and energy required. Although the block ice machine has a high average throughput, each cycle requires one to three days due to the large ice forms created. In addition, block ice machines can be up to 10 inches (25 centimeters) in height, resulting in less energy removed from the system over time, resulting in poor efficiency. The ice from a block ice machine must be post processed to achieve the desired form.

Still further, block ice machines need dedicated space, so much that restaurants and bars rarely have one onsite. From a fixed cost perspective, block ice machines and their complementary post processing equipment cost thousands of dollars. From a variable cost perspective, block ice machines require a plastic consumable every cycle, multiple labor-intensive steps, as well as energy to run post processing, storage, and delivery equipment.

What would thus be beneficial would be a method and mechanism to provide for a faster and more consistent ice growth. What would be beneficial would be a method and mechanism to minimize thermal resistance. What would be beneficial would be a method and mechanism that provides uniform ice forms with no parting lines or gate marks. What would be beneficial would be a method and mechanism that provides a protection from freezer burn. What would be beneficial would be a method and mechanism that prevents ice from being sintered together. What would be beneficial would be a method and mechanism to yield a substantially clear ice form with a lower concentration of impurities such as TDS/TDG than the initial water placed in the system. What would be beneficial would be a method and mechanism that does so in a cost effective, compact ice machine that creates a consistent and pleasant ice harvesting experience for the customer.

SUMMARY OF THE INVENTION

This Summary of the Invention is provided to introduce a selection of concepts in a simplified form that are further described below in the Detailed Description section. This Summary of the Invention is not intended to identify key features or essential features of the claimed subject matter, nor is it intended to be used as an aid in determining the scope or spirit of the claimed subject matter.

An ice machine in accordance with the principals of the present invention provides a thermal transfer surface directly coupled with a side of a tray leading to faster and more consistent ice growth. An ice machine in accordance with the principals of the present invention provides trays that are optimized (material and/or geometry) to minimize thermal resistance. An ice machine in accordance with the principals of the present invention provides uniform ice forms with no parting lines or gate marks. An ice machine in accordance with the principals of the present invention provides a protection from freezer burn. An ice machine in accordance with the principals of the present invention prevents ice from being sintered together. An ice machine in accordance with the principals of the present invention utilizes a velocity profile at the water/ice boundary layer to yield a substantially clear ice form with a lower concentration of impurities such as total dissolved solids (TDS) and total dissolved gasses (TDG) than the initial water placed in the system. An ice machine in accordance with the principals of the present invention can provide a cost effective, compact ice machine that creates a consistent and pleasant ice harvesting experience for the customer.

In accordance with the principals of the present invention, an ice machine, tray, tray insert, and process for producing high-quality, substantially clear ice are provided. A heat exchanger in the ice machine removes energy from liquid, cooling the liquid from room temperature to freezing temperature, then overcomes the heat of fusion to form ice. The tray containing a liquid is received in a freezing/mixing chamber. The tray includes an energy transfer surface in thermal contact with the heat exchanger to define a liquid/ice boundary layer. The tray further includes at least one freezing cavity having geometry defining surfaces to form the geometry of the ice. An egress area is defined in the tray above the geometry defining surfaces. An insert is adopted to be used in the freezing/mixing chamber. The insert comprises a surface apportioned to trap a small volume of liquid between the insert and the heat exchanger, thus hindering movement of the liquid underneath the inserts and providing a nucleation/seed site. A mixing mechanism is provided extending into the liquid, the mixing mechanism displacing the liquid thereby causing the liquid to flow to create a velocity profile at the liquid/ice boundary layer to create a directional freezing process starting from the energy transfer surface of the tray in thermal contact with the heat exchanger and growing through the freezing cavity up to the egress area. The velocity profile at liquid/ice boundary enables impurities to be washed away during the freezing process, deterring impurities from getting entrapped in the ice. Impurities in the liquid are thereby encouraged to be washed away and concentrate in a pool away from the ice, ultimately in the egress area of the tray to be purged. In addition, in embodiments sensors can be provided to provide various functions selected from the group consisting of, for example, determining ice creation status, determining freezing height, varying ice creation, determining tray presence, detecting freezing/mixing chamber door position, determining liquid level, and combinations thereof.

This Summary of the Invention introduces concepts in a simplified form that are further described below in the Detailed Description. This Summary of the Invention is not intended to identify key features or essential features of the claimed subject matter, nor is it intended to be used as an aid in determining the scope of the claimed subject matter.

BRIEF DESCRIPTION OF THE DRAWINGS

The accompanying Drawings illustrate several embodiments and, together with the description, serve to explain the principles of the present invention according to the example embodiments. It will be appreciated by one skilled in the art that the particular arrangements illustrated in and described with respect to the Drawings are merely exemplary and are not to be considered as limiting of the scope or spirit of the present invention in any way.

FIG. 18A shows a cut-away side schematic view of an example tray with multiple cavities filled with water and example single inserts for each cavity in accordance with the principals of the present invention.

FIG. 18B shows a cut-away side schematic view of an example tray with multiple cavities filled with water and example single inserts atop a pedestal for each cavity in accordance with the principals of the present invention.

FIG. 18C shows a cut-away side schematic view of an example tray with multiple cavities filled with water and an example single insert for multiple cavities in accordance with the principals of the present invention.

FIG. 18D shows a cut-away side schematic view of an example tray with a single cavity filled with water and an example single hollow insert which defines multiple cavities in accordance with the principals of the present invention.

FIG. 18E shows a cut-away side schematic view of an example tray with a single cavity filled with water and an example single solid insert which defines multiple cavities in accordance with the principals of the present invention.

FIG. 18F shows a cut-away side schematic view of an example tray with a single cavity filled with water and a single insert for that cavity in accordance with the principals of the present invention.

FIG. 18G shows a cut-away side schematic view of an example tray with a single cavity filled with water and an example single insert which defines multiple cavities having different cavity dimensions in accordance with the principals of the present invention.

Figure 1:
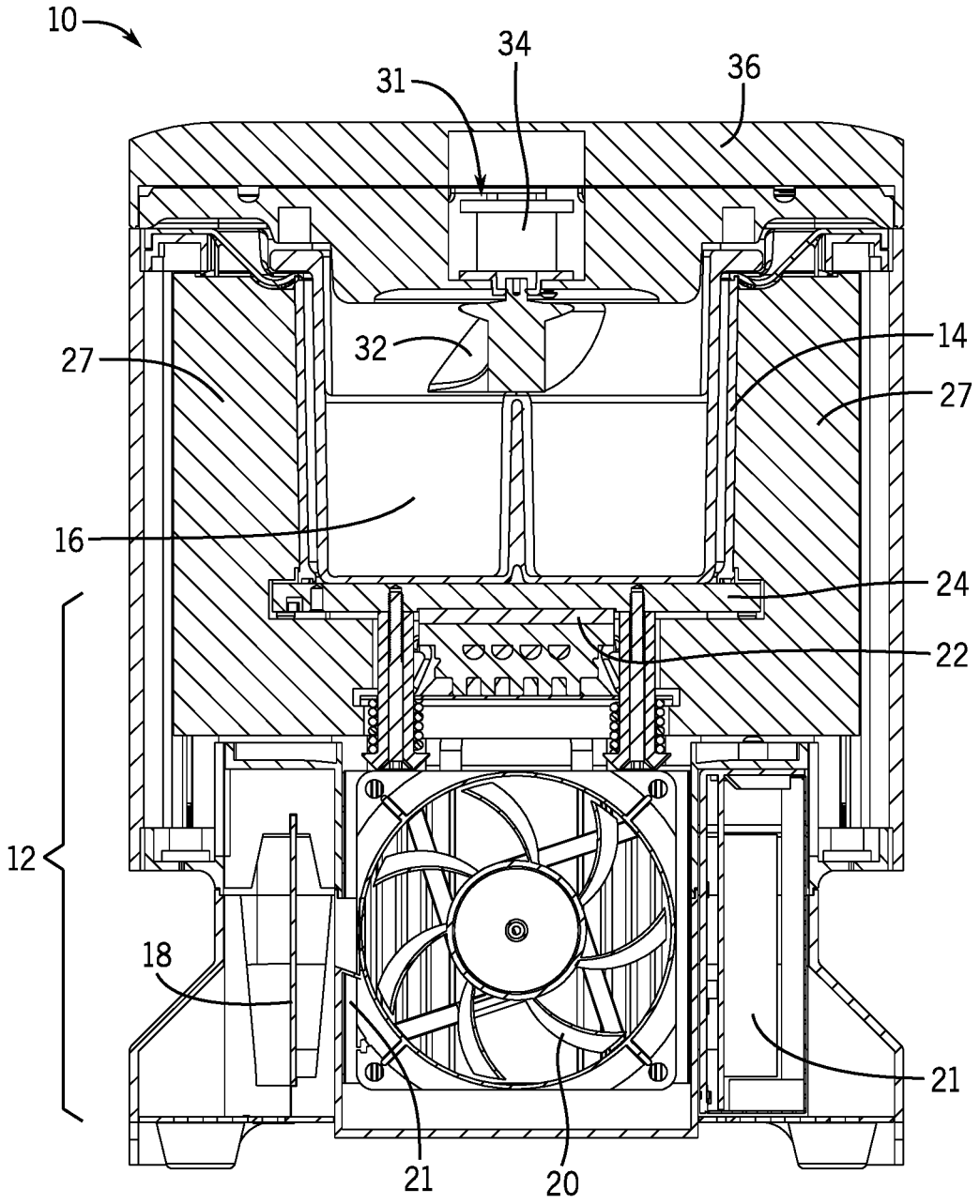
FIG. 1 is a cut-away front view of an exemplary ice machine in accordance with the principals of the present invention.

As noted above, in the above reference Drawings, the present invention is illustrated by way of example, not limitation, and modifications may be made to the elements illustrated therein, as would be apparent to a person of ordinary skill in the art, without departing from the scope or spirit of the invention.

DETAILED DESCRIPTION OF THE INVENTION

Introduction

An ice machine in accordance with the principals of the present invention provides a thermal transfer surface directly coupled with a side of a tray leading to faster and more consistent ice growth. An ice machine in accordance with the principals of the present invention provides trays that are optimized (material and/or geometry) to minimize thermal resistance. An ice machine in accordance with the principals of the present invention provides uniform ice forms minimizing parting lines or gate marks. An ice machine in accordance with the principals of the present invention provides protection from freezer burn. An ice machine in accordance with the principals of the present invention prevents ice from being sintered together. An ice machine in accordance with the principals of the present invention utilizes a velocity profile at the liquid/ice boundary layer to yield a substantially clear ice form with a lower concentration of impurities such as total dissolved solids (TDS) and total dissolved gasses (TDG). An ice machine in accordance with the principals of the present invention can provide a cost effective, compact ice machine that creates a consistent and pleasant ice harvesting experience for the customer.

An objective of designing ice machines in accordance with the principals of the present invention is to combine the ease of use of a silicone mold with the quality of a block ice machine, all of which can be produced at a price and contained in the size of a consumer kitchen appliance. To achieve this objective, a directional solidification process is used to encourage crystal structure growth that ultimately results in more pure, more dense ice solid that can be produced in a consumer kitchen appliance sized ice machine. The directional solidification process can be applied to encourage crystal growth of ice in one direction. The crystals in ice lead to better clarity and slower melting times. In the directional solidification process, the material starts as a liquid—for standard ice, water—and then energy is slowly drawn from the system either by the slow transition of the reservoir into a cooler area or by (a) surface(s) having the ability to continuously remove energy from the system. Directionally freezing can happen very slowly (like ice on a lake) or quickly with the use of refrigeration or another type of heat pump. As the rate of energy drawn from the system increases, a velocity profile is created at the liquid/ice boundary layer that encourages crystal growth and deters impurities such as TDS and/or TDG from getting entrapped in the crystal structure. This reduces "cloudiness" in the ice and with a low surface area to volume ratio and higher density, results in a slower melting rate.

Although long known, the demand for substantially large and clear ice forms has recently risen among cocktail, spirit, and coffee connoisseurs alike. Clear ice forms are used primarily for their aesthetically pleasing clarity as well as improved functionality such as slow melting properties due to the density and purity of the ice (due to reduced impurities such as TDS and/or TDG in the ice) and low surface area to volume ratio. As directional freezing is a filtering process, the final ice form has less impurities such as TDS and TDG than the initial liquid, impacting the taste of the drink less as it slowly melts.

An ice machine in accordance with the principals of the present invention is generally comprised of a heat exchanger, a freezing/mixing chamber adapted to receive a tray containing a liquid such as water, an electronics driver board, and a user interface. The primary function of the heat exchanger is to remove energy from the liquid, cooling the liquid from room temperature to freezing temperature, then overcoming the heat of fusion to form ice. The energy is typically transferred such as by being pumped to some form of heatsink and fan combination, then dissipated into the surrounding air.

The freezing/mixing chamber acts as a receptacle for the tray that contains the liquid. The freezing/mixing chamber includes insulative properties that mitigate energy loss through the sides, bottom, and top. A mixing mechanism can be integrated into the freezing/mixing chamber and has the ability to move in and out of the tray/liquid. To mitigate spillage and unwanted condensation, a door provided on the top can seal or create a torturous path with the top of the tray and/or freezing/mixing chamber.

The function of the electronics driver board is to convert AC power to DC power, power and control the heat exchanger, support any sensing elements, and shut down power to components of the system such as the heat exchanger and the mixing mechanism in the event of an unsafe condition. The user interface is in electronic communication with the electronics driver board and enables the user to command the ice machine and the ice machine to communicate any issues and/or status of the process to the user. These can be effectuated through the use of light, buttons, capacitive sensors and/or some other electronics or combination of mechatronics.

In addition to containing the liquid, defining the ice form, and enabling the user to transfer contents to/from ice machine and remove the ice, the design and interaction between the tray and the freezing/mixing chamber comprise a noteworthy aspect of the present invention. The tray can be defined as comprising an energy transfer surface, one or more freezing cavities or wells having geometry defining surfaces, and an egress area. The freezing cavities can be formed in the lower periphery of the tray and ultimately form the majority geometry of the ice. The lower wall or surface of the tray defines the lower wall or surface of the freezing cavities and acts as an energy transfer surface in thermal contact with an energy transferring surface of the heat exchanger.

A noteworthy aspect of the tray is the area provided for "egress". This egress area can be provided above the freezing cavities to allow for the mixing mechanism to be in contact with the liquid without inhibiting ice growth. Thus, the egress area can comprise the top portion of the tray above the freezing cavities. As the mixing mechanism is extended into the tray/liquid, the directional solidification process encourages crystal structure growth starting from the lower wall of the freezing cavities in thermal contact with the heat exchanger, thus acting as an energy transfer surface. As the rate of energy drawn from the system increases, a velocity profile is created at the liquid/ice boundary layer energy at the transfer surface that encourages crystal growth and deters impurities such as TDS and TDG from getting entrapped in the crystal structure to reduce impurities in and thereby increase the purity of the ice. This velocity profile at the liquid/ice boundary encourages impurities to be washed away and concentrate in a pool above the liquid/ice boundary and ultimately in the egress area of the tray during the freezing process.

In general, the geometry defining surfaces can be made of walls in different planes than the bottom surface. The geometry defining surfaces ultimately drive the XY-axis shape at a particular Z-axis height of the final ice form. These geometry defining surfaces or parts thereof can be made in the same molding process with the energy transfer surface of the tray. These surfaces should not inhibit the flow of fluid into and/or out of the egress area of the tray.

In addition, in embodiments various controls/sensors can be provided on ice machines in accordance with the principals of the present invention. Some controls/sensors on the ice machine are implemented to ensure safety and functionality of the machine components and the user; other controls/sensors are implemented to ensure performance. Performance can be characterized as growing ice consistently (same height) between machines and in different ambient environments; maintaining ice height/quality for set number of hours to provide the user flexibility in harvesting ice; and releasing ice safely and efficiently when user is present for harvesting.

One such control/sensor can comprise sensing top door position. Sensing the door position is noteworthy because the door insulates the top of the freezing/mixing chamber and tray during the ice generation cycle, enables the mixing mechanism to interact with liquid in the tray, and prevents a user from interacting with the mixing mechanism during operation Another such control/sensor can comprise tray presence. Sensing the tray presence is noteworthy to avoid the scenario where a user fills the freezing/mixing chamber but does not have tray inserted. Ideally the liquid would drain out of the ice machine if it is not sealed. As detailed below, this could cause a liquid level check to fail; if sealed, liquid would remain in the freezing/mixing chamber and the liquid level check would pass but tray check would fail. This would prevent liquid from freezing into large brick in the freezing/mixing chamber. The tray ensures proper sealing of the system and enables proper cubes to be formed.

Another such control/sensor can comprise liquid level. Sensing the liquid level is noteworthy because for the process to work properly the liquid needs to fill the freezing cavities as well as certain height up the egress area, which can be marked on the tray. No liquid will yield no ice, while insufficient liquid in the system will lead to cloudy ice, as the mixing mechanism will not be able to agitate the liquid appropriately.

Control(s)/sensor(s) can be used to notify the user that the ice generation cycle is completed. If the environment can be well understood and correlated to performance, a time-based system could be used to predict when the ice will be done; however, this has the opportunity to be far less accurate and could lead to under and/or overgrowth of the ice. Control (s)/sensor(s) can be used to take into account environmental factors that affect the ice generation cycle such as for example ambient air temperature, initial water temperature, and impurity concentration in the liquid to more accurately determine the status of the ice generation cycle. As further described below, additional controls/sensors can be provided for additional functionalities in additional embodiments of various ice machines in accordance with the principals of the present invention.

Initial Considerations

Generally, one or more different embodiments may be described in the present application. Further, for one or more of the embodiments described herein, numerous alternative arrangements may be described; it should be appreciated that these are presented for illustrative purposes only and are not limiting of the embodiments contained herein in any way. One or more of the arrangements may be widely applicable to numerous embodiments, as may be readily apparent to those skilled in the art.

In general, arrangements are described in sufficient detail to enable those skilled in the art to practice one or more of the embodiments, and it should be appreciated that other arrangements may be utilized and that structural, logical, electrical, and other changes may be made without departing from the scope or spirit of the present invention. Particular features of one or more of the embodiments described herein may be described with reference to one or more particular embodiments or figures that form a part of the present invention, and in which are shown, by way of illustration, specific arrangements of one or more of the aspects. It should be appreciated, however, that such features are not limited to usage in the one or more particular embodiments or figures with reference to which they are described. The present discussion is neither a literal description of all arrangements of one or more of the embodiments nor a listing of features of one or more of the embodiments that must be present in all arrangements.

Headings of sections provided in this patent application and the title of this patent application are for convenience only and are not to be taken as limiting the present invention in any way.

Devices and parts that are connected to or in fluid communication with each other need not be in continuous connection or fluid communication with each other, unless expressly specified otherwise. In addition, devices and parts that are connected to or in fluid communication with each other may fluid communicate directly or indirectly through one or more connection or fluid communication means or intermediaries, logical or physical.

A description of an aspect with several components in connection or fluid communication with each other does not imply that all such components are required. To the contrary, a variety of optional components may be described to illustrate a wide variety of possible embodiments and in order to more fully illustrate one or more embodiments.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments need not include the device itself.

Techniques and mechanisms described or referenced herein will sometimes be described in singular form for clarity; however, it should be appreciated that particular embodiments may include multiple iterations of a technique or multiple instantiations of a mechanism unless noted otherwise. Alternate implementations are included within the scope or spirit of various embodiments in which, for example, functions may be executed out of order from that shown or discussed, including substantially concurrently or in reverse order, depending on the functionality involved, as would be understood by those having ordinary skill in the art.

Conceptual Architecture

Figure 2:
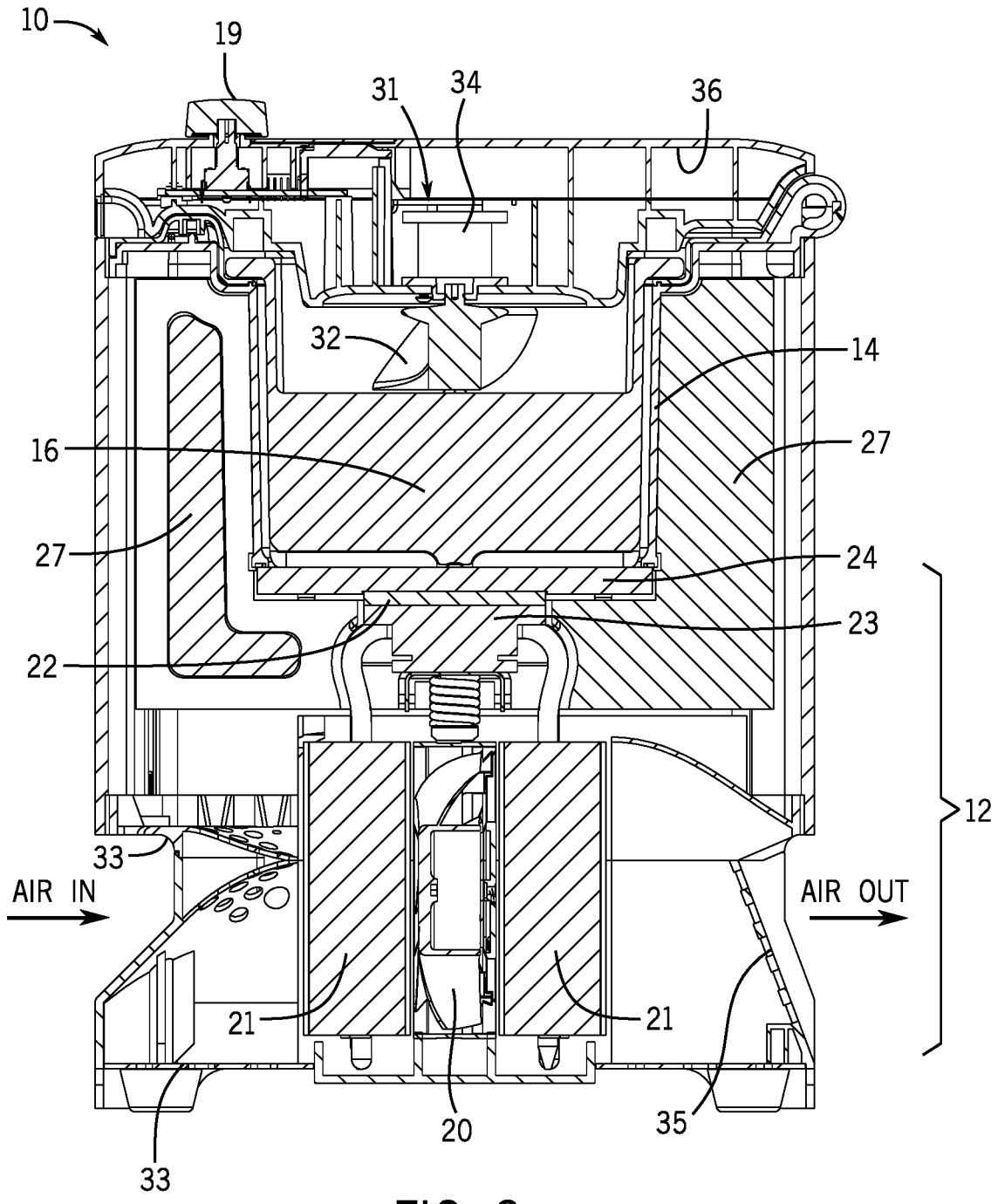
FIG. 2 is a cut-away side view of the ice machine of FIG. 1.

In more detail, FIG. 1 is a cut-away front view of an exemplary ice machine 10 in accordance with the principals of the present invention while FIG. 2 is a cut-away side view of the ice machine of FIG. 1. The ice machine 10 is generally comprised of a heat exchanger 12, a freezing/mixing chamber 14 adapted to receive a tray 16, an electronics driver board 18, and a user interface 19. The primary function of the heat exchanger 12 is to remove energy from the liquid, which in the exemplary embodiment described herein can be water, cooling the water from room temperature to freezing temperature, then overcoming the heat of fusion to form ice.

For efficiency, most prior art systems use refrigeration units to remove energy from water to make ice. These, however, can be expensive, large, heavy, noisy, and contain flammable material. These are also not well suited for consumer countertop appliances. In exemplary ice machines in accordance with the principals of the present invention, a thermoelectric cooler (TEC) element 22 can be provided as an element of the heat exchanger 12 that takes advantage of the Peltier effect, which creates a temperature difference at the junction of two different types of materials. The Peltier effect occurs when an electric current is passed through a circuit of a thermocouple, and heat is evolved at one junction and absorbed at the other junction. The absorption of heat at that junction results in the presence of cooling. The Peltier effect is named after French physicist Jean Charles Athanase Peltier, who discovered it in 1834. In addition to being known as a TEC, such an element can also be called a Peltier device, thermoelectric device/module/element, Peltier heat pump, solid state refrigerator, and occasionally a thermoelectric battery. The primary advantages of Peltier cooling are a lack of moving parts or circulating liquid, long life, invulnerability to leaks, small size, and flexible shape. Voltage to the TEC element 22 can be varied to increase cooling rate, efficiency, and/or thermal efficiency of the system. In some instances, providing more power to TEC element 22 will generate more cooling capacity but increase the heat dissipated, thereby negating any gains. Testing can be done to optimize the cooling rate, efficiency, and/or thermal efficiency of the system.

The TEC element 22 is typically coupled with another surface (known as cold plate or heat spreader) that helps evenly distribute the energy transfer. Thus, one side of the TEC element 22 can be connected to a cold plate 24. The cold plate 24 is positioned to contact the freezing/mixing chamber 14 and tray 16. Heat should be removed elsewhere away from the heat exchanger 12. The heat energy generated by the TEC element 22 is typically transferred away such as by being pumped to some form of heatsink 21 and fan 20 combination connected to the other side of the TEC element 22, then dissipated into the surrounding air. The heat exchanger 12 capacity can be impacted by fan 20 speed. Fan 20 speed can be adjusted up or down. At times, it may be advantageous to run the fan 20 at lower speed to reduce noise if additional cooling capacity is not necessary. In some instances, it also may not be easy to adjust TEC element 22 power so the fan 20 speed can be adjusted to make the system more or less efficient. The contact area between the TEC element, 22, heatsink 21 and cold plate 24 is also pertinent to energy transfer. Components can typically be held together in compression with springs and thermal grease applied in between components to account for any surface imperfections. In an exemplary embodiment, air can be drawn through the front of the ice machine 10 and out the back by the fan 20: to provide sufficient clearance for proper airflow; air inlets 33 can be created underneath the overhang of the freezing/mixing chamber 14 as well as the underside of the ice machine and an air outlet 35 created in the back. While in the exemplary embodiment described herein the heat exchanger 12 is oriented perpendicular alterative orientations such as having a fan plane parallel with the ground are within the scope of the invention.

Figure 12B:
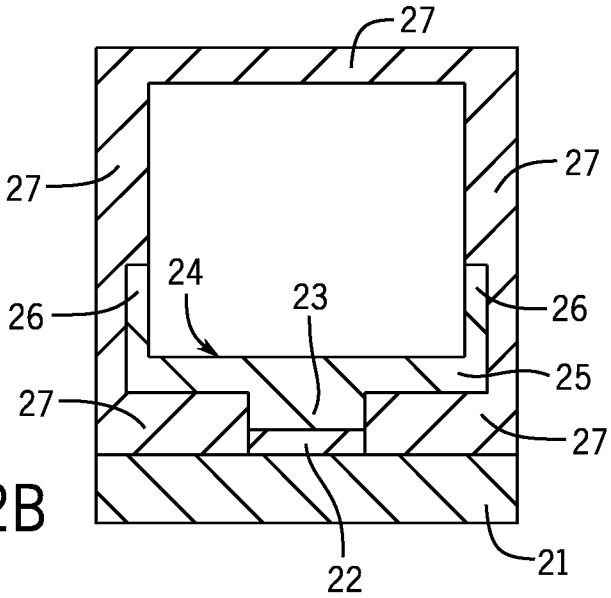
FIG. 12B shows a cut-away side schematic view of an example of a single TEC element with a modified cold plate in accordance with the principals of the present invention.

In an embodiment, the cold plate 24 can comprise a metal part such as aluminum with a pedestal 23 and a base 25 (seen in FIG. 12A), and optional side metal walls 26 (seen in FIG. 12B). The pedestal 23 can be an extruded feature that is approximately the same dimensions as the TEC element 22, creating an offset from the hot side, allowing insulation 27 to be placed in between, mitigating losses between the cold and hot sides. In another embodiment, a base 25 with no pedestal 23 feature can be provided. The base 25 can be roughly the same XY-axis dimensions as the tray 16. The cold plate 24 may have a uniform thickness or a varying thickness to more evenly distribute energy. The side walls 26 can utilize metal to enable more cooling surface area to be in contact with the tray 16, leading to faster freeze times. These cold plate 24 features can be coupled with one or more TEC elements 22 (seen in FIG. 12C) or a refrigerant system 90 (seen in FIG. 12D). For the exemplary embodiment described herein, the cold plate 24 can be oriented near the middle of the ice machine 10, with the tray 16 being placed on top of the cold plate 24; however, it should be noted that this could be oriented upright (higher or lower), sideways or upside down.

The freezing/mixing chamber 14 has multiple purposes. Initially, the freezing/mixing chamber 14 acts as a receptacle for the tray 16 that contains the liquid, and is adapted to interact with the design characteristics of the tray 16 detailed below. The freezing/mixing chamber 14 includes insulative properties 27 that mitigate energy loss through the sides and top to aid in freezing the ice. A mixing mechanism 31 is provided in contact with the water to provide a velocity profile at the water/ice boundary layer without inhibiting ice growth. An additional benefit of the mixing mechanism 31 is to dissipate any temperature spikes in the liquid to provide a more uniform temperature profile at the water/ice boundary layer. A minimum mixing rate is needed to produce clear ice at specific times (ice heights) throughout the process. It may be advantageous to alter or turn off the mixer speed or flow direction to optimize growth rate and clarity and mitigate other process anomalies that may arise during certain points in the process.

An example of a mixing mechanism 31 can be an axial impeller 32 mixer connected to a DC motor 34. The mixing mechanism 31 can be integrated into the top door 36 of the freezing/mixing chamber 14 to have the ability to move in the Z-axis to be lifted in and out of the tray/water 16. The axial impeller 32 will be in contact with the water and thus should be made of food safe materials. To mitigate spillage and unwanted condensation, the top door 36 can seal or create a torturous path with the top of the tray 16 and/or freezing/mixing chamber 14. The freezing/mixing chamber 14 can also include sensing elements to determine the ice height. Additional detail on the design considerations with respect to the freezing/mixing chamber and such sensors is described below.

Figure 3:
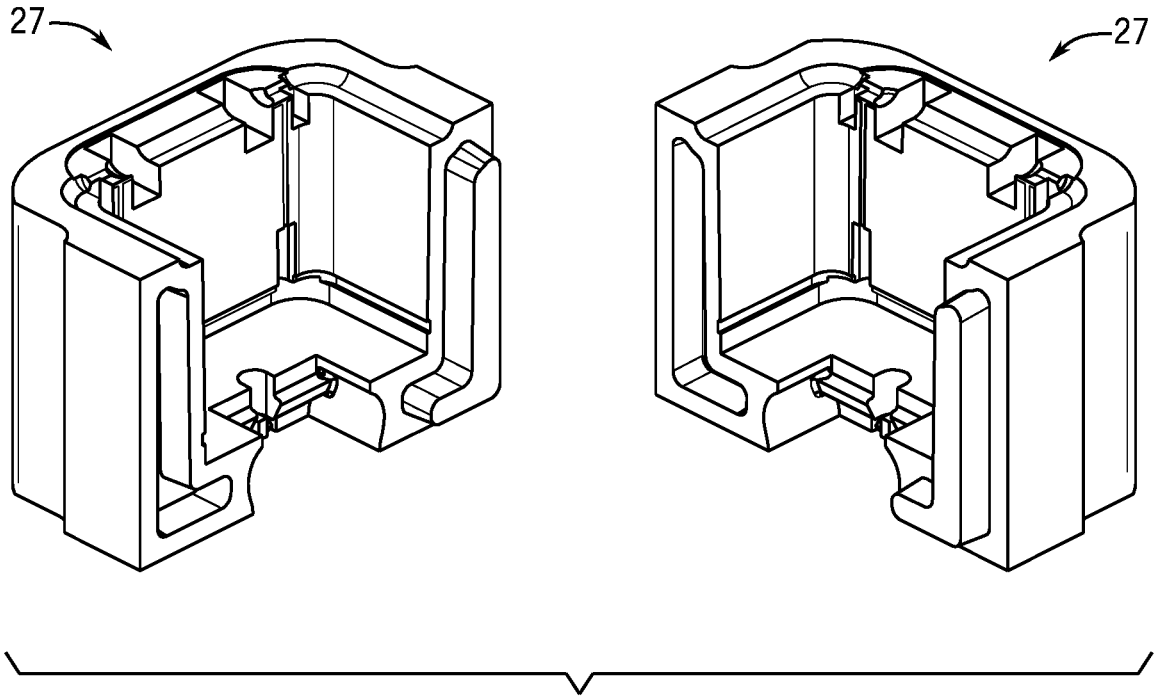
FIG. 3 is an exploded, perspective view of insulation of the ice machine of FIG. 1.

In an ideal world, the bottom surface of the freezing/mixing chamber 14 would be isothermal (some fixed heat transfer (Q) (positive or negative) pumped evenly across the surface) and the side walls and top would be adiabatic (no Q into or out of the system); in reality that is not possible. To compensate, it can be advantageous to provide insulation 27 to the vertical walls, top surface, and in between the cold plate 24 and heatsink 21 to minimize losses to the ambient environment. Referring to FIG. 3, an exploded, perspective view of insulation 27 of the ice machine of FIG. 1 is seen. It is understood that some losses will occur; the goal is to minimize the unevenness of losses in each portion (bottom, sides, top). Unevenness or poorly designed insulation can impact the final form of the ice negatively and/or also make for a less efficient system. For example, if more energy is lost on the front than the back of the ice machine 10, the ice can grow slower in the front than in the back. The top could be evenly insulated in a similar fashion; however, it is understood that the water in the tray creates insulation between the top and ice as well as the mixing mechanism 31 adds energy into the system.

Areas that are insulated should also look to minimize or eliminate air/moisture transfer as air/moisture transfer could create condensation and/or ice in unwanted areas. These insulated areas should also be waterproof and/or have properly designed drainage as it is likely to be spilled on. In ice machines in accordance with the principals of the present invention, the bottom surface and portions of the side surfaces can be optimized to remove significant energy from the system. The remaining side surfaces and top surfaces can be insulated to limit energy transfer into the system. In the exemplary embodiment described herein, about one to two-inch (two to five centimeters) of expanded polystyrene (EPS) and/or expanded polypropylene (EPP) or other insulation can be used on sides, top, and in between the heatsink 21 and cold plate 24 to achieve adequate insulation.

The electronics driver board 18 can include a power supply and a printed circuit board (PCB) assembly. Functions of the electronics driver board 18 can include to convert AC power to DC power, and to power and control the heat exchanger 12, power and control the mixing mechanism 31, power and control the user interface 19, support any sensing elements, and shut down the system in the event of an unsafe condition. The user interface 19 enables the user to command the ice machine 10 and enable the ice machine 10 to communicate any issues and/or status of the process to the user. These interactions can be effectuated through the use of a display screen, lights, buttons, capacitive sensors and/or some other electronics or combination of mechatronics. In an exemplary embodiment, the electronics driver board 18 can be placed alongside the heat exchanger 12 in the lower portion of the ice machine 10 to separate from the freezing/mixing chamber 14.

Figure 4A:
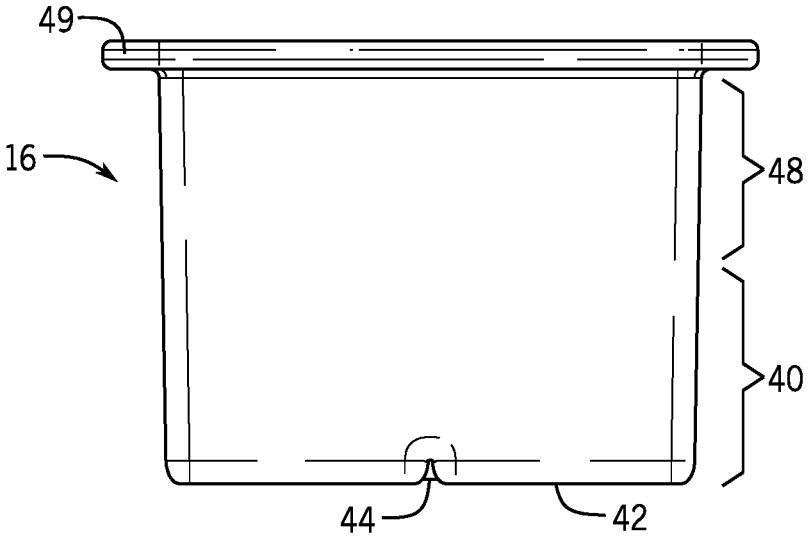
FIG. 4A is a frontal, elevated view of a tray in accordance with the principals of the present invention.
Figure 4B:
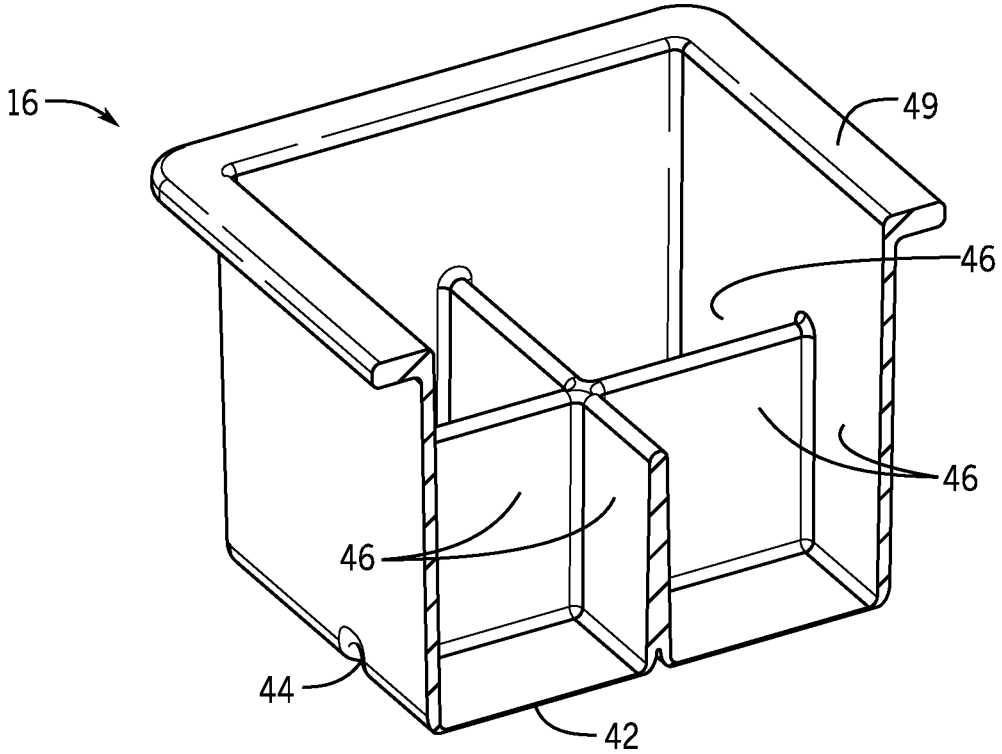
FIG. 4B is a perspective, cut-away view of the tray of FIG. 4A.

Referring to FIG. 4, FIG. 4A shows a frontal, elevated, view and FIG. 4B shows a perspective, cut-away view of an exemplary tray 16 in accordance with the principals of the present invention. The tray 16 contains the liquid, defines the ice form, enables the user to transfer contents to/from the ice machine 10, and enables the user to remove the ice. Thus, the tray 16 can be made of flexible, food safe material (such as for example thermoplastic elastomers (TPE) or silicone). The tray 16 can comprise one or a series of freezing cavities or wells 40 which ultimately form the majority geometry of the ice. The size, shape, and number of these freezing cavities 40 can be changed based on preference; in the exemplary consumer kitchen appliance ice machine 10 described herein, four freezing cavities 40 can be provided to provide a reasonable quantity of ice without unduly adding to the size of the appliance. The lower periphery of the tray 16 comprises an energy transfer surface 42 in thermal contact with the cold plate 24 of the heat exchanger 12, which likewise acts as energy transfer surface. This energy transfer surface 42 can also act as a geometry defining surface for the final ice form. In some instances, it may be advantageous for this surface to have different properties (surface energy, thermal conductivity, roughness etc.) than the other geometry defining surfaces to aid in ice generation. To aid in ice removal, the underside of the energy transfer surface 42 can further define the freezing cavities 40 with internal grooves 44. Additionally to aid in ice removal, the surfaces 46 of each freezing cavity 40 can provide a slight draft and/or be made of material with low surface energy and/or roughness. Additional detail on the design considerations with respect to the energy transfer surfaces is described below.

Since the tray 16 will be handled by the user, it may be advantageous to have a handle 49 on the tray 16. This handle 49 makes it easier for the user to carry the tray 16 to and from the ice machine 10. This handle 49 could be made of the same material as the rest of the tray 16, a different material or imbedded within (over molded). Typically, the preference is for the handle 49 to be stiffer than the rest of the tray 16 which can be achieved with different materials, thickness, and/or geometries.

In an embodiment, the walls of the tray 16 in different planes than the bottom surface can define geometry defining surfaces 46. These geometry defining surfaces 46 could be less than an inch in length (a few millimeters) and/or extend up nearly to the full height of the tray 16. Geometry defining surfaces 46 ultimately drive the XY-axis shape at a particular Z-axis height of the final ice form. The geometry defining surfaces 46 or parts thereof can be made with the energy transfer surface 42 of the tray 16 in contact with the cold plate 24 which acts as the energy transferring surface of the heat exchanger 12. The geometry defining surfaces 46 should not inhibit the flow of fluid into and/or out of the egress area of the tray 16. Additional detail on the design considerations with respect to the geometry defining surfaces is described below.

As previously discussed, a noteworthy feature of the tray 16 is the egress area 48. In the exemplary embodiment described herein, the egress area 48 comprises the top portion of the tray 16 above the freezing cavities 40. The intent is for this egress area 48 to not freeze, but rather stay in a liquid form to help impurities such as total dissolved solids (TDS) and/or total dissolved gasses (TDG) to be washed away from the water/ice boundary layer by the mixing mechanism 31 to accumulate and concentrate in a pool during the freezing process. In the absence of this egress area 48, the ice could be cloudy and high in TDS/TDG content. An additional benefit of the egress area is the presence of a liquid above the ice and the heat exchanger 12 provides a level of insulation at the water/ice boundary layer. This egress area 48 also allows for the mixing mechanism 31 to be in contact with the liquid without inhibiting ice growth above the freezing cavities 40. Additional detail on the design considerations with respect to the egress is described below.

The tray 16 can include features to enable sensing of water or ice height level and components to transmit the presence of the tray 16. The tray 16 may also incorporate locating features. These features could be combined into the aforementioned handle features or be separate. A goal could be to ensure proper XY-axis alignment between the tray 16 and ice machine 10 when it is inserted. This is necessary for proper contact/alignment with the cold plate 24 and any sensors.

A feature could be added to the bottom of the tray 16 that could make it easier for the user to remove the ice. This could be a small indent or notch 44 in the bottom of each well or significant cut out allowing each freezing cavity 40 to be individually "popped" out. As previously introduced, in embodiments various controls/sensors can be provided on ice machines in accordance with the principals of the present invention. Thus, sensor(s) can be provided to determine the position of the top door 36. The sensor can comprise a contact or non-contact switch such as a mechanical limit switch or hall-effect sensor to determine whether the top door 36 is open or closed. The door sensor can operate with controls to ensure the ice generation cycle will not start until door position is "closed". An error could be flagged if door is opened during operation. Opening the door removes the mixing mechanism 31 from liquid, stopping agitation and enabling impurities to be frozen into the ice. The amount of time and/or number of times the top door 36 is open during an ice generation cycle could yield different outcomes: continuing the ice generation cycle could still yield ice but it may grow slower and be cloudy. Regardless, this risk should be communicated to the user through the user interface. Ending the ice generation cycle would ensure the intended process is not compromised; however, users may want to see the process as it goes without having to sacrifice their entire ice cube, even if it does yield some imperfections. Either way, if the top door 36 is opened during operation, power to the mixing mechanism 31 should be removed to reduce the likelihood of harm to the user.

Likewise, sensor(s) can be provided to determine tray 16 presence. The sensor can comprise a contact or non-contact switch such as a mechanical limit switch or hall-effect sensor that could interact with a feature on the tray 16 to determine whether the tray 16 is present. The tray sensor can operate with controls to ensure the ice generation cycle will not start until tray position is "present".

Other controls/sensors can be provided to sense the liquid level. The sensor can comprise monitoring the current draw of the motor 34 driving the mixing mechanism 31 to determine whether liquid is present and if present whether the tray 16 is under-filled, sufficiently filled or overfilled. The current draw sensor can operate with controls to ensure the ice generation cycle will not start until liquid level is "sufficient/present." Different current ratings can be specified for open air, operational, and stalled scenarios for the mixing mechanism 31. For example, the mixing mechanism motor 34 powered at a fixed voltage, could draw 0.05 A when impeller 32 is rotated in air; at the same voltage in water, the motor 34 could draw 0.2 A and, if stalled, the motor 34 could pull greater than 0.4 A. If the motor 34 reads a low amperage, the user will be notified that the tray 16 may not be filled to the proper height with water; if an average amperage is read, the process will move forward; if the amperage reads high, the ice generation cycle may not be started and the user will be notified. A float sensor, time of flight sensor and variety of other sensors could be used to directly or indirectly verify liquid level.

If the ice generation cycle is in progress and the motor 34 amp draw changes to high or low, the process could be put into a "safe" state to reduce additional damage to the ice machine and/or a recovery state to try and finish the cycle. If during the ice generation cycle the motor 34 reads low amperage—it may be that the top door 36 was opened but the door sensor not properly triggered and/or water has leaked out of the tray 16 and into other parts of the ice machine. In either situation, power to the motor 34 and potentially the heat exchanger 12 should be shut off and an error communicated to the user.

If during the ice generation cycle the motor 34 reads high amperage—it may be the ice has grown into the mixing mechanism 31, the mixing mechanism 31 has become physically obstructed by the tray 16 or other component and/or the top door 36 has been opened (door sensor not working) and the user has come in contact with the mixing mechanism 31. In either situation, for safety power to the motor 34 and potentially the heat exchanger 12 should be shut off and an error communicated to the user. If during the ice generation cycle the motor 34 reads average amperage, the cycle should continue. A reasonable sampling rate/control scheme should be implemented to present false positives.

While ice making machines of all sizes scaled for various application are contemplated as within the scope of the principals of the present invention, the exemplary ice machine 10 described herein is designed to be produced at a cost and size of a consumer kitchen appliance and is thus generally in the range of about eight inches (12 centimeters) in depth and width and about 12 inches (30 centimeters) in height. In addition, the exemplary system in accordance with the principals of the present invention described herein targeted to make four, two inches (five centimeters) cubes in less than 12 hours; however, it should be understood that the principals of the present invention can be scaled up or down to have higher or lower throughput and efficiency as well as larger or smaller ice forms. Likewise, the size, shape and number of freezing cavities 40 in the tray 16 can be changed based on preference. The tray 16 for the exemplary four, two inches (five centimeters) cube system described herein defines four two inches (five centimeters) by two inches (five centimeters) by two inches (five centimeters) freezing cavities 40, yielding the four, two inches (five centimeters) cubes. An alternative home-consumer embodiment could define 1.75 inches (four centimeters) by 1.75 inches (four centimeters) by 1.75 inches (four centimeters) dimensions while a system for bars and restaurants may scale up to 1-100+ cubes per ice generation cycle.

Figure 5:
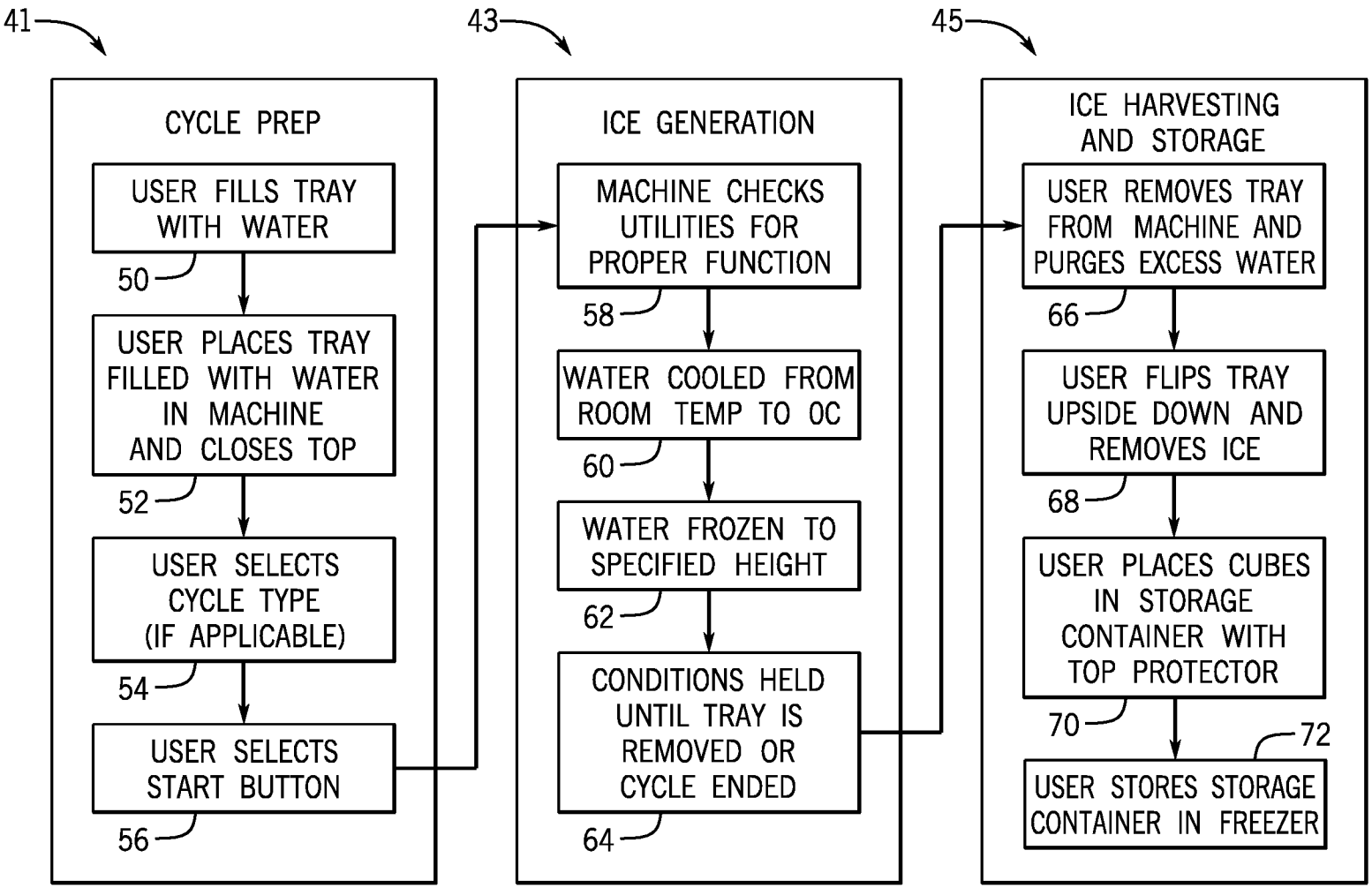
FIG. 5 is a flow chart of an example ice generation cycle in accordance with the principals of the present invention.

Referring to FIG. 5 in conjunction with FIG. 6, an example of an exemplary ice generation cycle flow chart in accordance with the principals of the present invention is seen in FIG. 5 while in FIG. 6 the exemplary ice generation cycle flow of FIG. 5 is seen from the perspective of the tray 16. The exemplary ice generation cycle can be categorized into an initial cycle preparation phase 41, an ice generation phase 43, and a final harvest and storage phase 45. To initiate the cycle preparation phase, the user fills the tray 16 with water to a specified height using water from their tap or pre-filtered water 50. A cut-away side schematic view of a filled tray 16 can be seen in FIG. 6A. The tray 16 is filled to a height greater than the height of the freezing cavities 40; in an embodiment, the tray 16 can have a fill line to guide the user on how high to fill the tray 16. This allows for the top of the ice to freeze clearly in the freezing cavities 40 and allow for highly mineralized water to accumulate above the ice in the egress area 48.

Figure 6A:
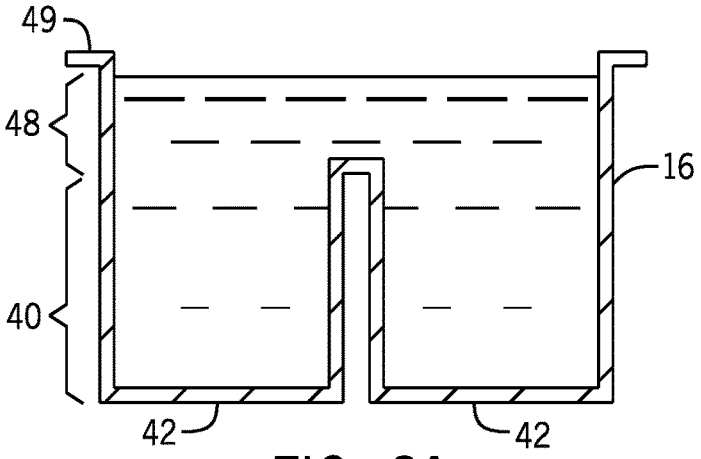
FIG. 6A shows a cut-away side schematic view of a filled tray corresponding to a step in the exemplary ice generation cycle of FIG. 5.
Figure 6B:
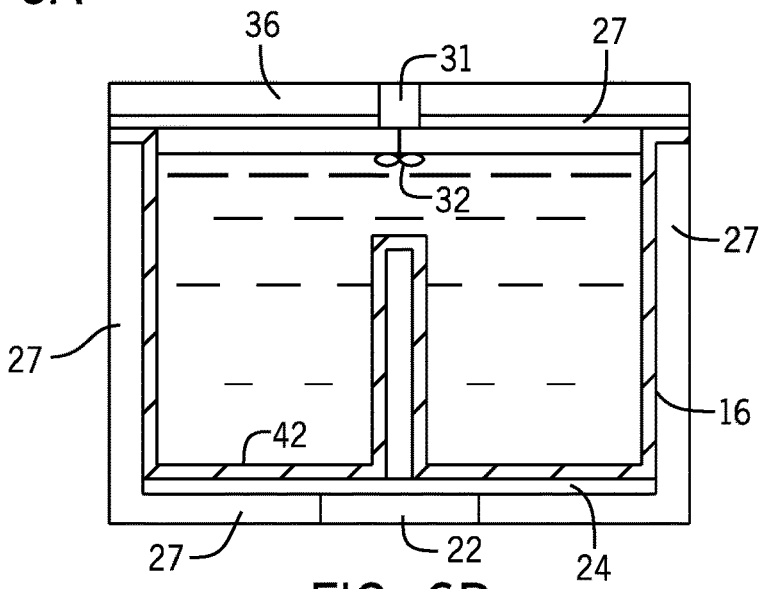
FIG. 6B shows a cut-away side schematic view of the filled tray of FIG. 6A placed in an ice machine corresponding to a step in the exemplary ice generation cycle of FIG. 5.
Figure 6C:
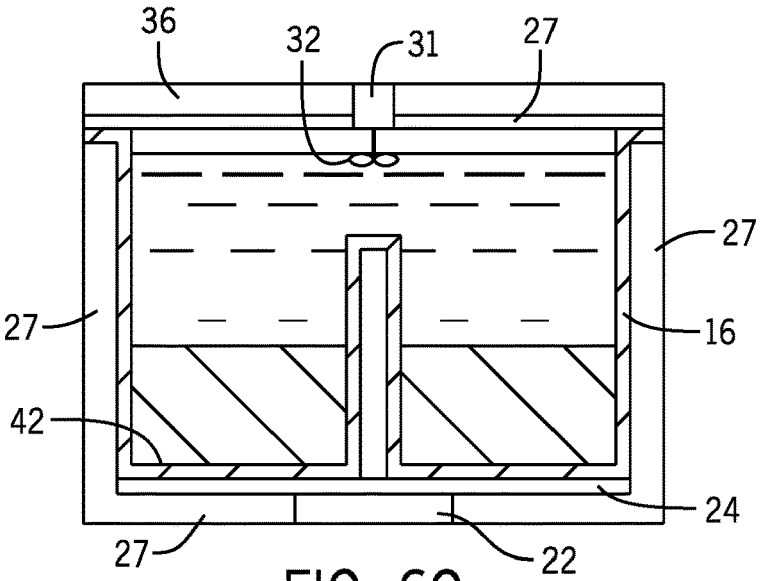
FIG. 6C shows a cut-away side schematic view of a water/ice boundary layer corresponding to a step in the exemplary ice generation cycle of FIG. 5.
Figure 6D:
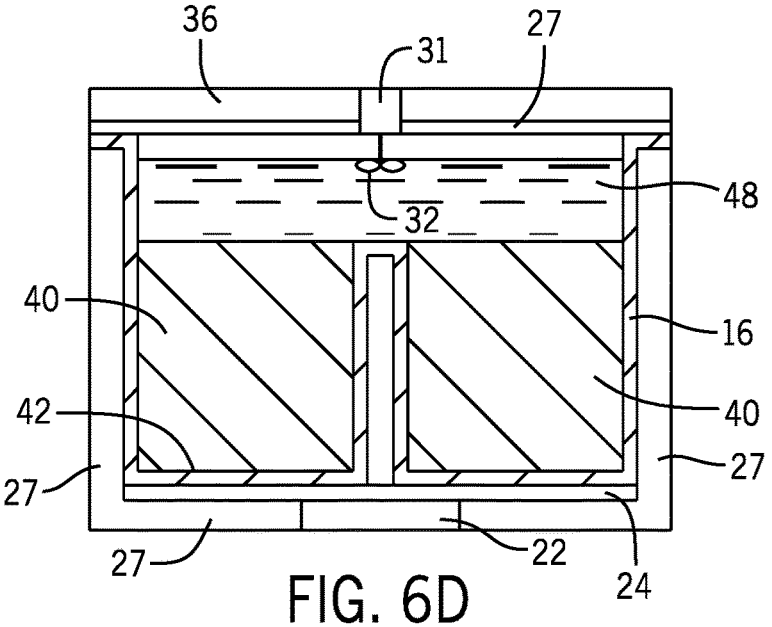
FIG. 6D shows a cut-away side schematic view of another water/ice boundary layer corresponding to a step in the exemplary ice generation cycle of FIG. 5.
Figure 6E:
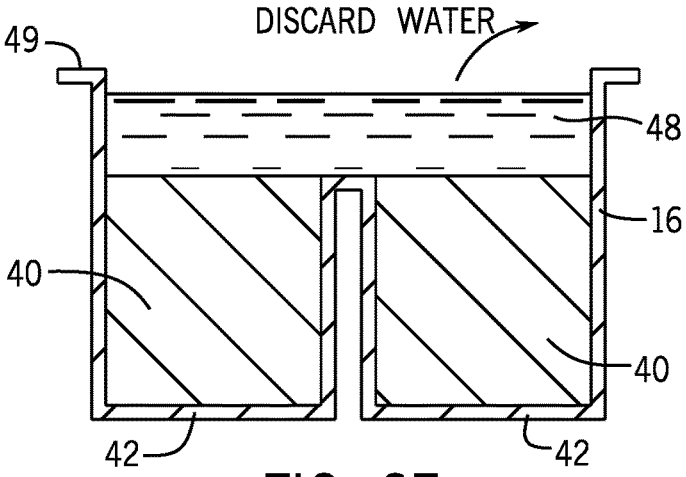
FIG. 6E shows a cut-away side schematic view of a removed tray from the ice machine corresponding to a step in the exemplary ice generation cycle of FIG. 5.
Figure 6F:
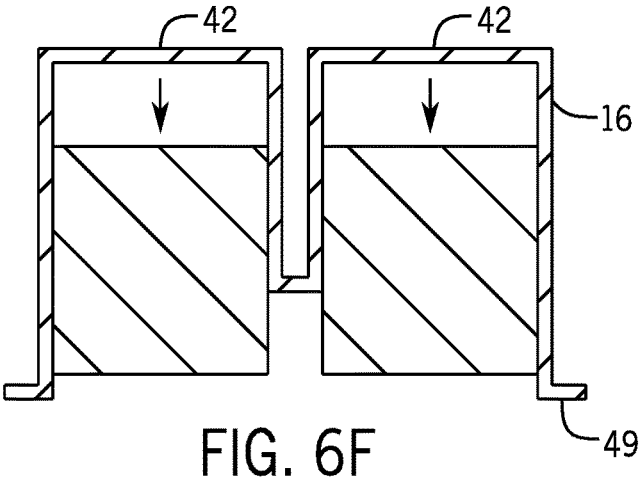
FIG. 6F shows a cut-away side schematic view of ice being removed from a tray corresponding to a step in the exemplary ice generation cycle of FIG. 5.

The filled tray 16 is then placed in the freezing/mixing chamber 14 of the ice machine 10 and the top is closed 52, as seen in the cut-away side schematic view of FIG. 6B. This places the energy transfer surface 42 of the tray 16 in thermal contact with the cold plate 24 and thus the energy transfer surface of the heat exchanger 12 of the ice machine 10, brings the water into contact with the mixing mechanism 31, and isolates the water within thermal insulation for freezing. The user then initiates the ice generation phase by interacting with the user interface such as for example selecting an ice generation cycle type 54 and the start button 56.

Following the selection of the start button, the ice generation stage is initiated wherein the ice machine 10 can perform a self-check to ensure components are working properly 58. This may or may not include checking fan performance, heat exchanger performance, door status, tray status, water level, ice level, water temp, air temperature and/or other components of the utility functions. Next, the heat exchanger 12 works to cool the water from room temperature to freezing temperature 60, then convert water to ice up until a specified height 62. This occurs while a mixing mechanism 31 creates a velocity profile at the water/ice boundary layer. In the cut-away side schematic view of FIG. 6C, the water/ice boundary layer is seen approximately halfway up the freezing cavities 40. As the ice grows the water contained in the egress area 48 becomes more and more concentrated with impurities, which will eventually be purged. The ice machine 10 can have the capability to communicate to the user the status of the process and any errors that may have occurred. Once a specified ice height is achieved, the system can control the mixing and/or cooling and/or other functions to maintain the height until tray 16 is removed to harvest the ice 64. This is seen in the cut-away side schematic view of FIG. 6D, where the water/ice boundary layer is seen having grown to encompass the freezing cavities 40.

Ice harvesting and storage is the final step in the process. Here, the user notifies the machine they are present. The ice machine stops cooling/maintaining the ice. In some cases, the tray 16 may freeze to the cold plate 24, making it difficult to remove right away. The system can simply be allowed to passively warm so the user can open the lid of the ice machine 10 and remove the tray 16 from the freezing/mixing chamber 14 of the ice machine 10, as seen in the cut-away side schematic view of FIG. 6E. Or the polarity of the TEC element 22 can be flipped and the cold side actively heated. If a refrigeration system is used, one could change the flow direction of the refrigerant relative to the condenser and evaporator. Actively heating the cold plate could reduce the harvest time from minutes down to seconds. Again, the temperature sensors on the cold and hot side of the heat exchanger can be used to monitor this portion of the process.

The user then discards or purges the layer of water contained in the egress area 48 concentrated with impurities 66. The user can then remove the ice from each freezing cavity 40 by flipping the tray 16 upside down 68, as seen in the cut-away side schematic view of FIG. 6F. As previously described, to further aid in ice removal, the underside of the energy transfer surface 42 of the tray 16 can define the freezing cavities 40 with internal grooves 44 and each freezing cavity 40 can provide a slight draft. The ice forms can then be consumed, stored in a separate container with a top protector to mitigate freezer burn 70, and placed in a freezer or left in the original tray 16 and placed in a freezer 72.

As previously described, the exemplary system in accordance with the principals of the present invention described herein is targeted to make four, two inches (five centimeters) cubes in less than 12 hours; a beta test device in accordance with the principals of the present invention was able to produce such ice in five hours with the cold plate at −21° C. (−6° F.). If the environment can be well understood and correlated to performance, a time-based system could be used to predict when the ice will be done in order to alert the user that the ice generation cycle is complete; however, while straightforward to implement, this has the opportunity to be less than accurate and could lead to under and/or overgrowth of the ice. For example, an ice machine in a 68° F. (20° C.) environment will perform much differently than an ice machine in a 78° F. (26° C.) room. With an ice machine only reaching −18° C. (0° F.) based on environmental conditions, the ice generation cycle time could get adjusted to six hours or something depending on what testing shows. Additional variables that can affect ice generation cycle time can include: initial water temperature—the ice generation cycle could be prolonged by hot water and shortened with cold water; and impurity concentration—testing has shown that distilled and highly concentrated water can prolong cycle time, with distilled water limiting the number of nucleation sites for ice to form and highly concentrated water, with sugar or salt for example, decreasing the freezing temperature.

Alternatively, to account for these environmental variables sensing/control can be utilized to determine the completion of the ice generation cycle. For example, temperature sensors can be placed at various locations, such as air intake, air outtake, heat exchanger hot side, heat exchanger cold side, and locations within the freezing/mixing chamber/tray. Measuring air intake temperature helps the ice machine understand the ambient environment in which it is operating; measuring the air outtake temperature helps the ice machine understand the heat dissipation of the system and also identify if any obstacles prevent air from exiting the ice machine (such as a wall, etc.) Measuring the hot and cold side of the heat exchanger as a function of time can inform how quickly ice is growing. These temperature measurements can also be pertinent for ice harvesting in which the polarity of the TEC element is swapped such that the cold side becomes the hot side and slightly melts the ice to release the tray. These measurements can also be used for safety and shut down power to the heat exchanger and/or system if one side gets too hot during any part of the ice generation cycle. In other embodiments, measuring just the hot or the cold side may provide sufficient information and the other temperature can be inferred based on benchtop testing.

Figure 7:
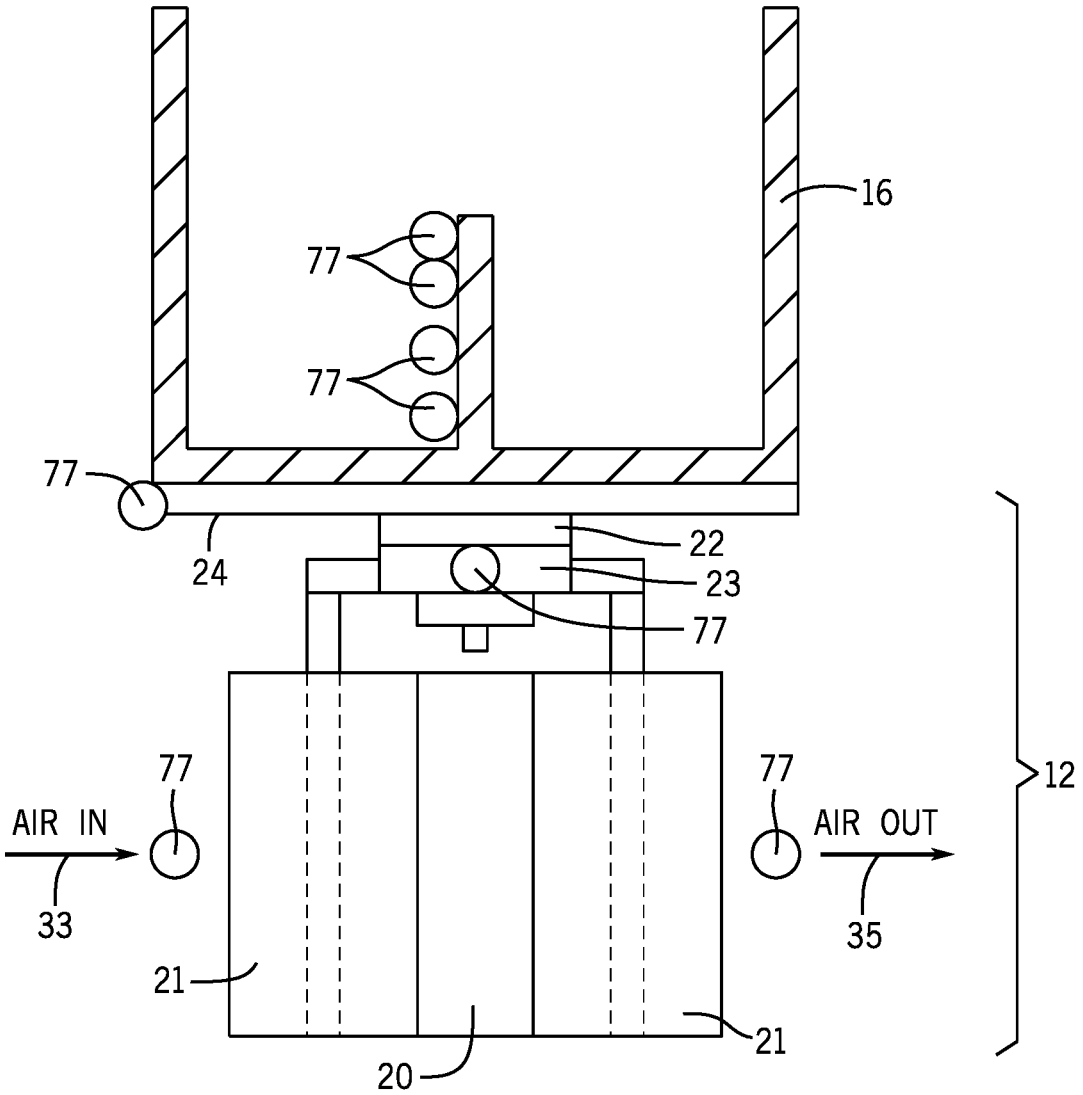
FIG. 7 is a cut-away, side schematic view of an example sensor placement in an ice machine in accordance with the principals of the present invention.

Referring to FIG. 7, a cut-away, side schematic view of an ice machine in accordance with the principals of the present invention is seen showing an exemplary embodiment with a plurality of sensors 77 such as temperature sensors to measure temperature placed as follows: in this example, the hot/pedestal 23 side and the cold/cold plate 24 side of the heat exchanger 12, air inlet 33, and air outlet 35 as well as 10, 25, 45 and 50 mm from bottom of the tray 16. This exemplary embodiment was utilized to collect data on performances of certain aspects of ice machines in accordance with the principals of the present invention as described with respect to FIG. 8 below and as such mixing was not performed in these experiments as the ice quality was not at issue.

Figure 8A:
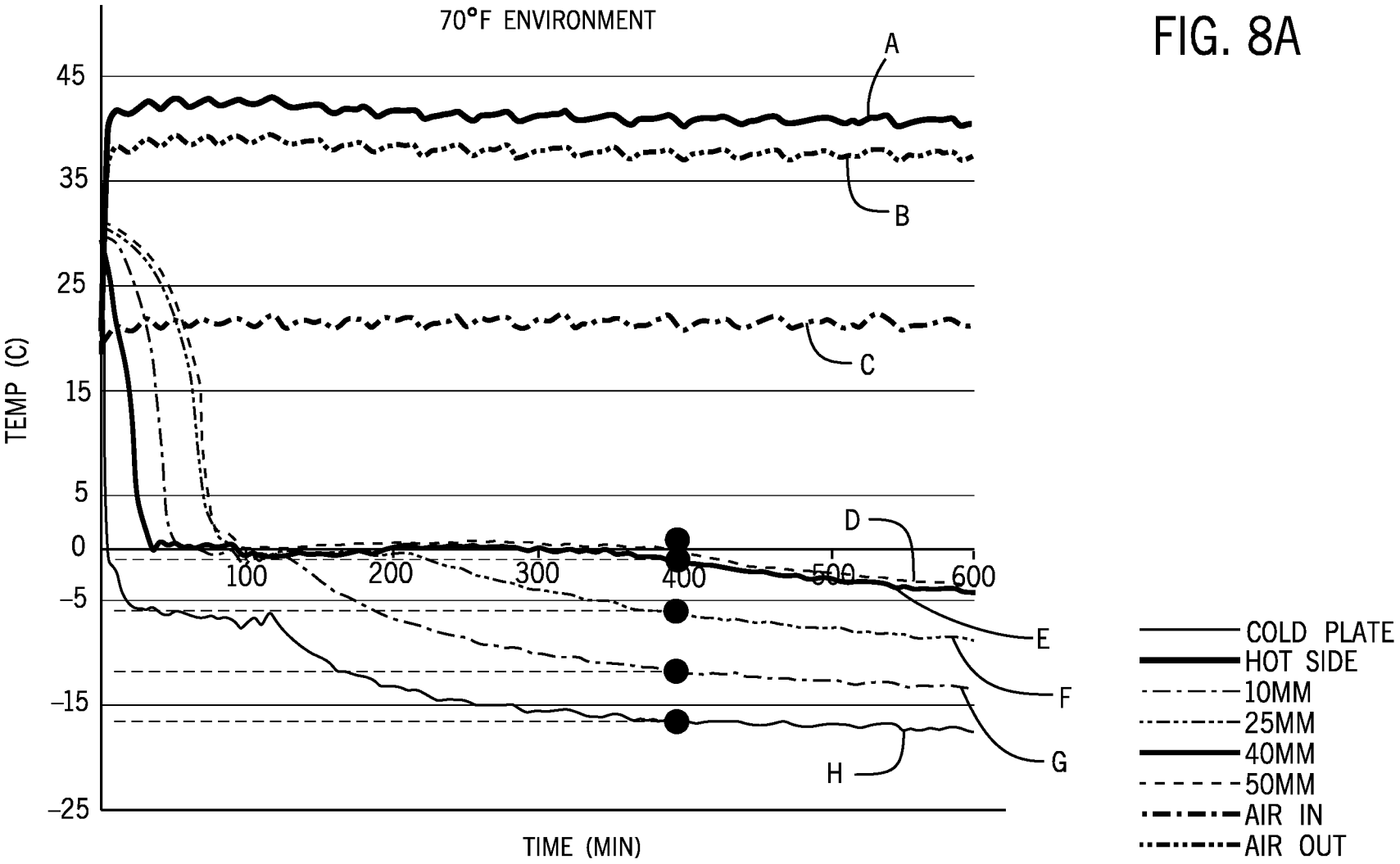
FIG. 8A is a graph of temperature data collected at the sensor placement points of FIG. 7 in an environment with the ambient air temperature of 70° F. (21° C.).
Figure 8B:
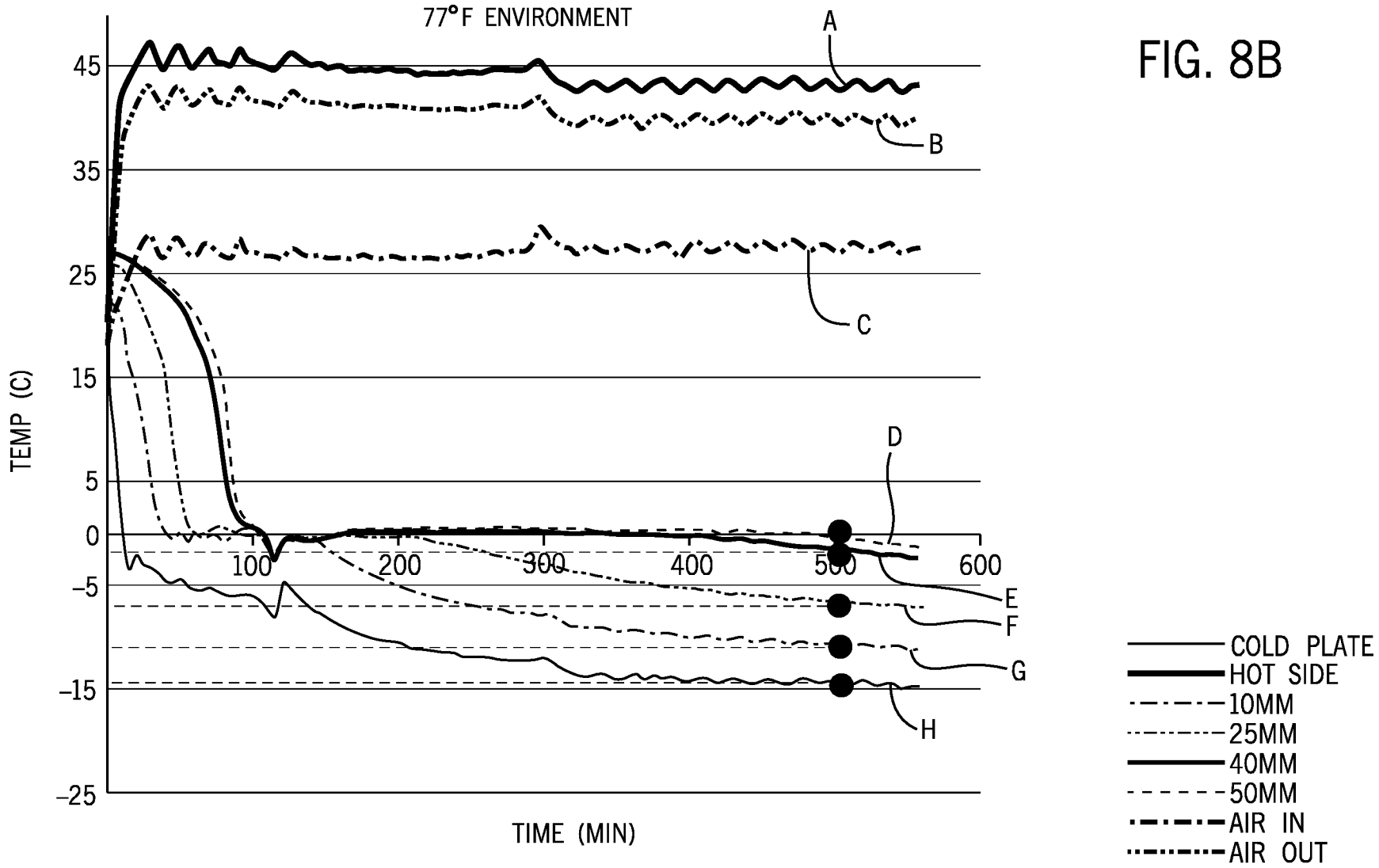
FIG. 8B is a graph of temperature data collected at the sensor placement points of FIG. 7 in an environment with the ambient air temperature of 77° F. (25° C.).
Figure 9C:
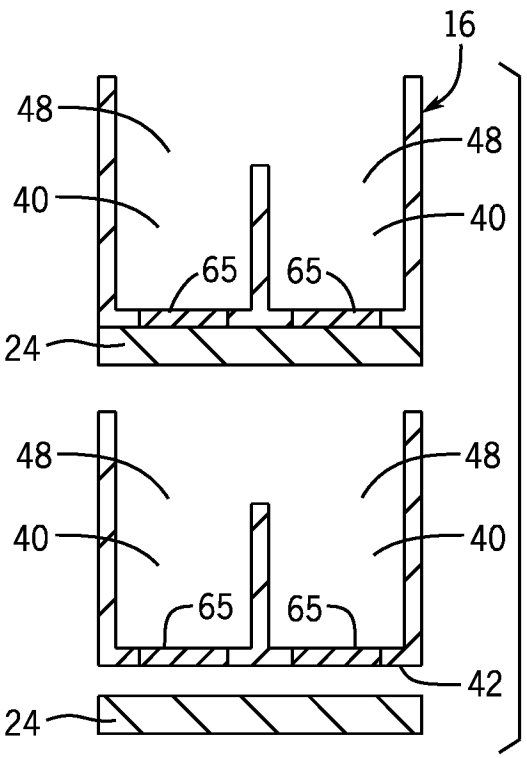
FIG. 9C shows a cut-away side schematic view of another example of an alternative tray configuration in accordance with the principals of the present invention.
Figure 9B:
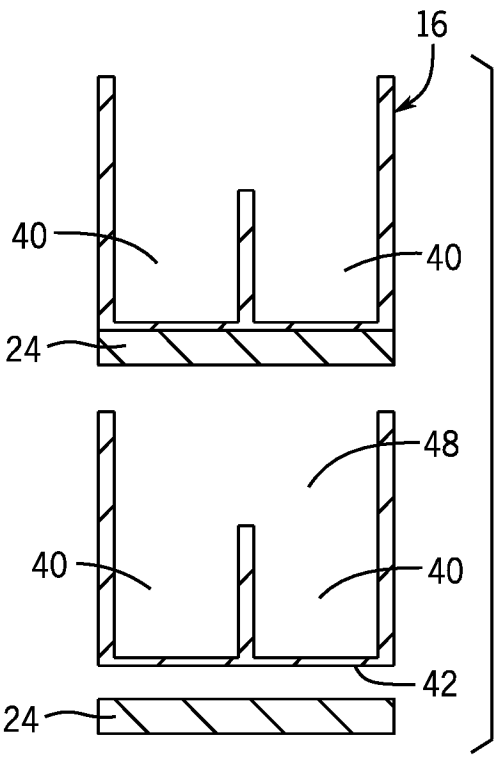
FIG. 9B shows a cut-away side schematic view of an alternative tray configuration in accordance with the principals of the present invention.
Figure 9A:
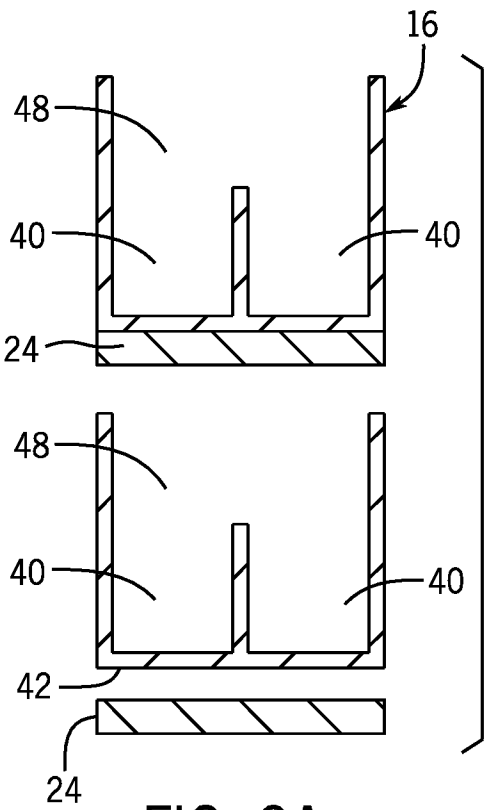
FIG. 9A shows a cut-away side schematic view of an example of a tray configuration in accordance with the principals of the present invention.
Figure 9E:
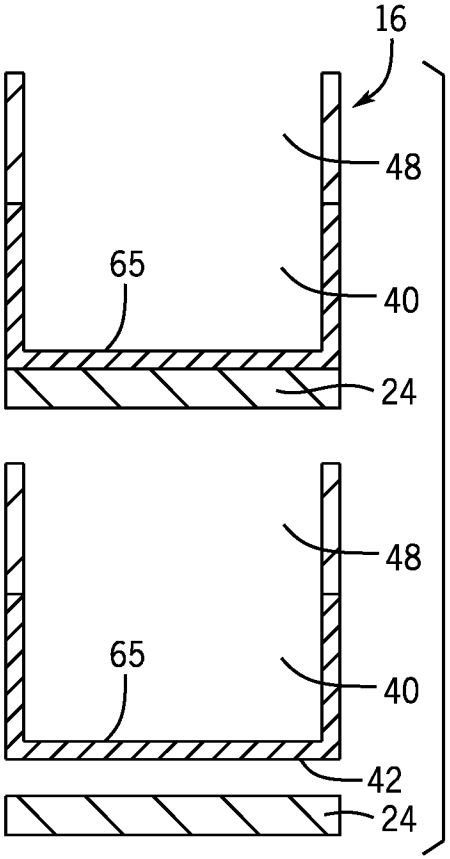
FIG. 9E shows a cut-away side schematic view of another example of an alternative tray configuration in accordance with the principals of the present invention.
Figure 9D:
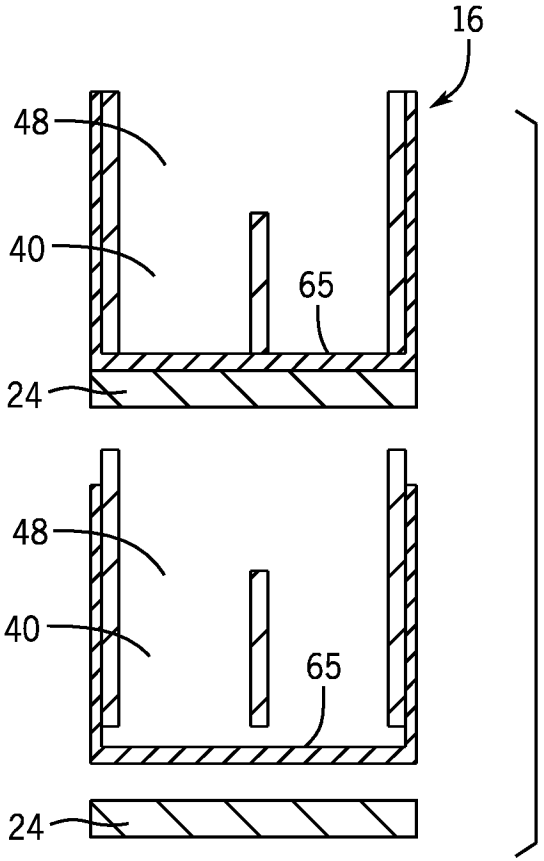
FIG. 9D shows a cut-away side schematic view of another example of an alternative tray configuration in accordance with the principals of the present invention.

FIG. 8A is a graph of temperature data collected at the temperature collection points of FIG. 7 in an environment with the ambient air temperature of 70° F. (21° C.) while FIG. 8B is a graph of temperature data collected at the sensor placement points of FIG. 7 in an environment with the ambient air temperature of 77° F. (25° C.), where the temperature (in Celsius) is displayed along the vertical axis and time (in minutes) is displayed along the horizontal axis. In FIGS. 8A and B, the top line (A) represents the temperature at the hot side of the heat exchanger 12, the next lower line (B) represents temperature at the air outlet 35, the next lower (C) the temperature at the air inlets 33; the bottom line (H) represents the temperature at the cold side of the cold plate 24, the next higher (G) the temperature at 10 mm height in the tray 16, the next higher (F) the temperature at 25 mm height in the tray 16, the next higher (E) the temperature at 45 mm height in the tray 16, the next higher line (D) the temperature at desired ice height of 50 mm in the tray 16.

As is shown, temperature of the water in the tray 16 sharply drops to ~0° C. (32° F.) then holds around 0° C. (32° F.) until a phase change occurs, then the water/ice starts cooling down further. This second change, which could be marked by temperature values below 0° C. (32° F.) for some set time or count, relative temperature values lower than average temperature values over a set time, a rate of temperature value change over time or some other metric, signals ice has formed. The dots on the graph represent the temperature when the 50 mm temperature sensor goes below 0° C. (32° F.) indicating that the ice generation cycle is completed: the temperature of the cold plate 24 in FIG. 8A when the ambient air is 70° F. (21° C.) is thus seen to be approximately −18° C. (−0.4° F.) when the desired ice height of 50 mm thermocouple goes below 0° C. (32° F.), indicating that the ice generation cycle is completed; the temperature of the cold plate 24 in FIG. 8B when the ambient air is 77° F. (25° C.) is thus seen to be approximately −14° C. (−6.8° F.) when the desired ice height of 50 mm thermocouple goes below 0° C. (32° F.), indicating that the ice generation cycle is completed. In this example, instead of commanding the ice machine to make ice until the about 400-minute mark, the ice making cycle would proceed until a cold plate 24 temperature of less than −18° C. (−0.5° F.) was achieved. Taking ambient temperature as an input, the ice making cycle could be adjusted for time, target temperature or some combination thereof to achieve desired ice growth and maintenance until user is ready to harvest. This adjustment could happen at the start of each cycle or be dynamic during the process. It is understood that other input variables such as initial water temperature could be used to adjust cycle parameters. In some cases, it may not be possible for the machine to automatically account for and adjust cycle parameters. In these cases, the user may have ability to manually adjust parameters through the user interface.

It is also well understood that these sensors may not be accurate and precise initially or over time. This could be accounted for through one time and/or periodic calibration, measuring absolute and/or relative values, and/or compensating in the controls or some combination thereof.

As previously discussed, the design and interaction between the tray and the freezing/mixing chamber comprise a noteworthy aspect in the formation of the ice. Thus, several additional considerations should be kept in mind in designing embodiments of energy transfer surfaces, the geometry defining surfaces, the egress, the heat pump configuration, and the mixing mechanism in accordance with the principals of the present invention, as described below.

Energy Transfer Surfaces

The energy transfer surfaces have a direct impact on growth rate, as a thermal resistance between the water/ice and the heat exchanger. These energy transfer surfaces can be on one or multiple faces of the tray, or on certain surfaces of the tray and other surfaces of the ice machine. The energy transfer surfaces can be designed to optimize for low thermal conductivity material or high thermal conductivity material and combinations thereof to balance growth rate and usability.

In an embodiment, the energy transfer surface 42 on the lower periphery of the tray 16 can comprise a low thermal conductivity material (such as plastic). This could be silicone, a thermoplastic polyurethane (TPU), a thermoplastic elastomer (TPE), and/or combinations of silicones, TPUs, TPEs, and of other plastics. If low thermal conductivity materials such as these are used, the thickness can be minimized to improve energy transfer between the cold plate 24 which acts as the energy transferring surface of the ice machine 10 and the liquid/ice. These materials can be easily molded into different shapes, thicknesses, and durometers, in order to tune for a positive ice removal process by the user. The tray wall thickness, durometer, and constraint within the ice machine 10 can impact the final ice shape; if not designed properly, ice can not only freeze up but out, which can create a non-uniform shape. A scenario could exist where the walls of the freezing cavities 40 of the tray 16 are ultrathin and when placed into the ice machine 10, conform to the geometry of the freezing cavity 40.

Referring to FIG. 9, cut-away side schematic views of examples of a plurality of alternative tray configurations are seen: FIG. 9A shows the tray 16 of the exemplary embodiment described herein where each freezing cavity 40 has its own bottom or energy transfer surface 42 but shares the internal walls with other freezing cavities 40; FIG. 9B shows an embodiment where the thickness of the energy transfer surface 42 has been minimized to improve energy transfer with the cold plate 24—another option could be to have individual walls up to a certain height and then share a wall to another height.

In alternative embodiments a combination of high and low thermal conductivity material could be used to enable good energy transfer and an enjoyable ice removal process. In an embodiment, the energy transfer surface 42 can comprise a high thermal conductivity material (such as metal). This material can be added to the tray 16 or strategically placed around the tray 16 as part of the ice machine 10 to increase the energy removal from the water/ice. Thus, in FIG. 9C metal 65 has been added to portions of the energy transfer surface 42; in FIG. 9D metal 65 has replaced the energy transfer surface and extends the entire height of the outer walls of the tray 16; and in FIG. 9E, a single freezing cavity 40 is comprised of metal 65; however, it should be noted that each of these design iterations can have downsides including manufacturing complexity, non-uniform final ice shape, and poor ice removal experience as the ice could have to be re-melted from the rigid surfaces.

A potential problem in certain designs is poor contact between the energy transfer surface 42 of the tray 16 and the cold plate 24 acting as the energy transfer surface of the ice machine 10. XY-axis alignment is driven by the negative freezing cavity 40 and/or locating features made by the ice machine 10. Z-axis planarity issues can be mitigated a few ways. One is to optimize the tray 16 energy transfer surface 42 to be thin and flexible, allowing the weight of the water to conform the tray 16 surface to the energy transfer surface 42 of the ice machine 10. With more rigid material, it may be desirable to control planarity more tightly and/or place a downward force on the tray 16 to encourage more intimate contact between the two energy transfer surfaces 42, 24. Typically mating of two energy transfer surfaces is done with screws, welds or some other force; special material such as thermal paste or pads can be placed in between to account for surface roughness. Generally, it is preferred that configurations maintain a tray 16 that is removable.

It may be advantageous to adjust the surface roughness, geometry, and/or surface energy of the energy transfer surface to aid in the initial nucleation and ice formation. Limited nucleation sites could create a super cooled liquid and negatively impact the clear ice making process.

It is also possible to imprint different designs onto the bottom of the tray 16. The positives and/or negatives of these designs could be transferred to a face or multiple faces of the final ice form.

Geometry Defining Surfaces

As previously discussed, the geometry defining surfaces play a noteworthy role in the formation of the ice. The geometry defining surfaces 46 ultimately drive the XY-axis shape at a particular Z-axis height of the final ice form. These geometry defining surfaces 46 or parts thereof could be made of, or be in contact with the energy transferring surface 42 of the tray 16 or cold plate 24 acting as the energy transferring surfaces of the ice machine 10. In an embodiment, the geometry defining surfaces 46 can be made of walls in different planes than the bottom surface 42 of the tray 16. These geometry defining surfaces 46 could be a few millimeters in length and/or extend up to the full height of the tray 16. These geometry defining surfaces 46, just like energy transferring surface 42, can be made for each individual freezing cavity 40, shared by multiple freezing cavities 40 or some combination thereof. One noteworthy aspect is these geometry defining surfaces 46 should not inhibit the flow of fluid into and/or out of the egress area 48 of the tray 16.

Initial testing has shown that some level of rigidity is needed along these geometry defining surfaces 46 to maintain the desired ice shape throughout the freezing process. This stiffness can be designed into the tray 16 and/or the ice machine 10. This stiffness can be designed into the tray 16 by choice of materials with an appropriate structural rigidity and thickness or combining different materials; this stiffness also can be designed into the ice machine 10 wherein the geometry defining surfaces 46 are supported by walls of freezing/mixing chamber 14 of the ice machine 10 to form the geometry of the ice.

Figure 10B:
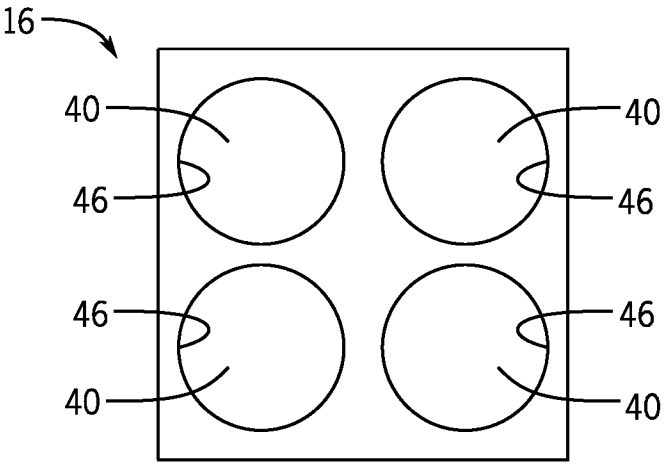
FIG. 10B an overhead view of an example four cylindrical cubes freezing cavity configuration in accordance with the principals of the present invention.
Figure 10D:
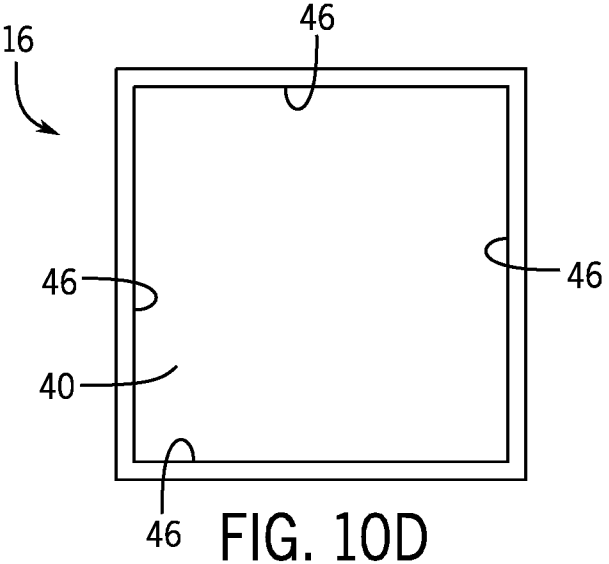
FIG. 10D an overhead view of an example single large cube freezing cavity configuration in accordance with the principals of the present invention.
Figure 10A:
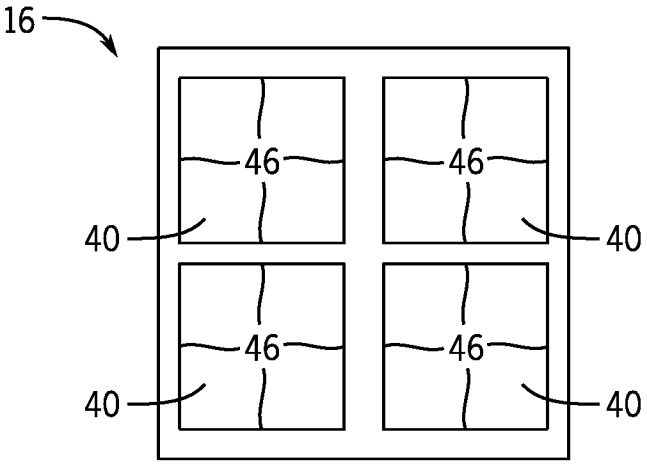
FIG. 10A shows an overhead view of an example four square cube freezing cavity configuration in accordance with the principals of the present invention.
Figure 10C:
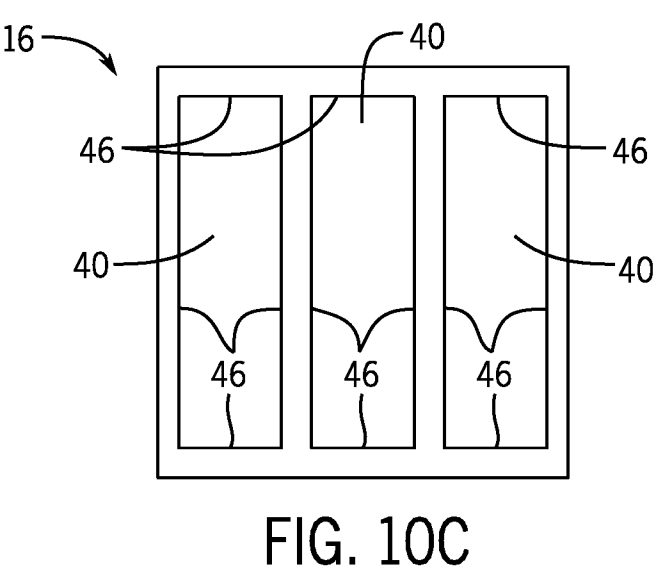
FIG. 10C an overhead view of an example three rectangular cubes freezing cavity configuration in accordance with the principals of the present invention.

It should be noted that the XY-axis shape and Z-axis height of the geometry defining surfaces 46 could significantly impact the size and/or depth of the egress, requirements of the mixing system, and/or other process hardware and variables (like sensor location). An example of this is a high aspect ratio freezing cavity (large Z-axis distance relative to XY-axis distance) may require a positive displacement pump instead of an impeller to create the necessary velocity profile at the water/ice boundary layer. This is discussed in more detail below. Some examples of different cross-sectional (XY-axis) shapes the tray 16 could create are shown in the overhead views of FIG. 10, where FIG. 10A shows freezing cavities 40 for the four cube of for example two inch length by two inch width by two inch height of the exemplary embodiment described herein, FIG. 10B shows freezing cavities 40 for an embodiment with four cylindrical cubes of for example two inch diameter by two inch height, FIG. 10C shows freezing cavities 40 for an embodiment with three rectangular cubes of for example 4.5 inch length by 1.25 inch width by 1.25 inch height, and FIG. 10D shows a single large freezing cavity 40 of for example 4.75 inch length by 4.75 inch width by 2 inch height.

Egress

Figure 11A:
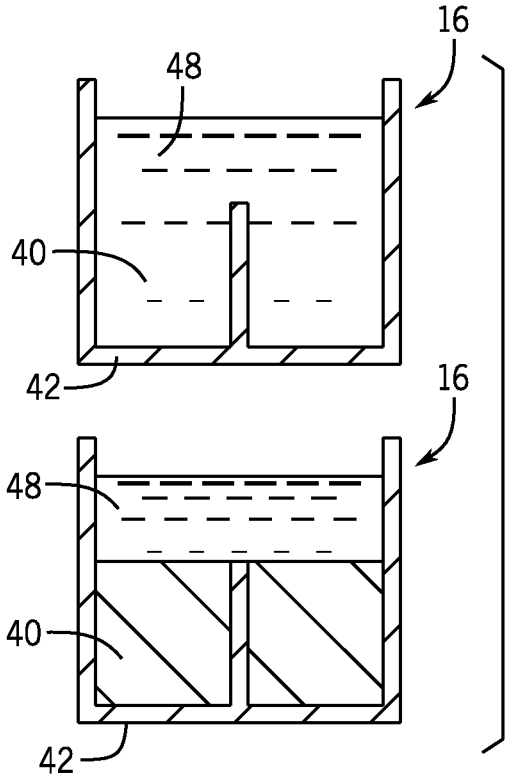
FIG. 11A shows a cut-away side schematic view of an example embodiment of a single egress area shared between two or more freezing cavities in accordance with the principals of the present invention.
Figure 11B:
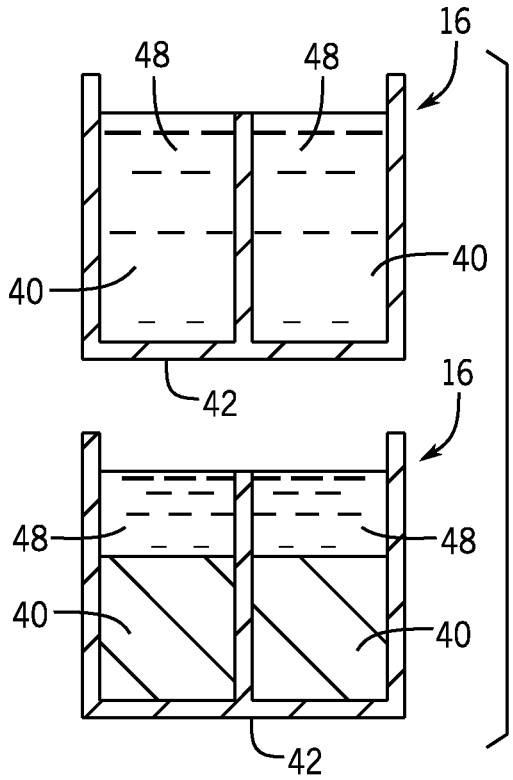
FIG. 11B shows a cut-away side schematic view of an example embodiment of a dedicated egress area for each freezing cavity in accordance with the principals of the present invention.
Figure 11C:
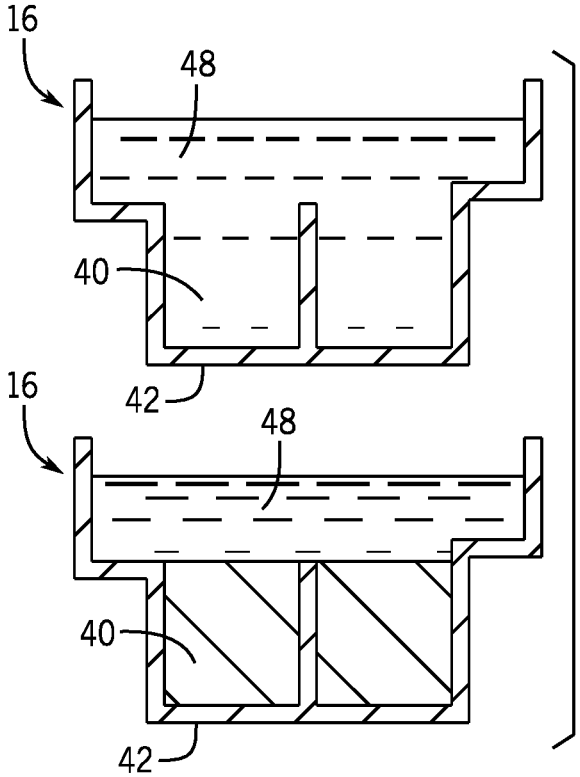
FIG. 11C shows a cut-away side schematic view of an example embodiment of a single expanded egress area relative to the freezing cavity width shared between two or more freezing cavities in accordance with the principals of the present invention.
Figure 11D:
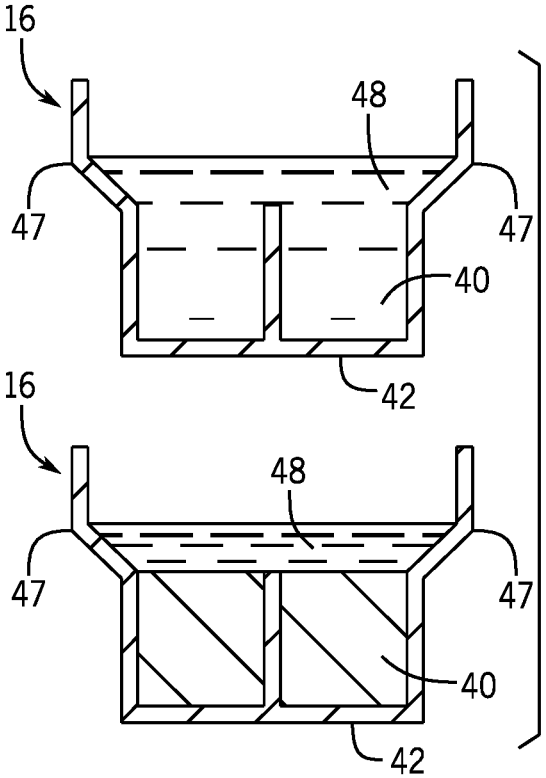
FIG. 11D shows a cut-away side schematic view of an example embodiment of an expanded egress area relative to the freezing cavity width having angled walls shared between two or more freezing cavities in accordance with the principals of the present invention.

As previously discussed, the egress plays a noteworthy role in the formation of the ice. The egress area 48 exists above the well/freezing cavity 40 created by the geometry defining surfaces 46 and bottom 42 of the tray 16. This egress area 48 does not freeze, but rather stays in a liquid form to accumulate impurities washed away from the water/ice boundary layer by the mixing mechanism 31. The egress area 48 can take on many forms, including sharing some or all of the geometry defining surfaces 46 from the freezing cavity 40 below or taking on its own defined area. The egress area 48 could also be open to/shared between multiple freezing cavities 40 or be used on a one-to-one ratio between egress area 48 and freezing cavity 40. The egress area 48 must contain some percentage volume of water relative to the water volume within the freezing cavities 40. A number of factors can impact this, including the aspect ratio of the freezing cavity 40, total freezing cavity 40 volume, mixing mechanism 31 type, concentration of input water, and other process and hardware variables. Examples of egress area 48 forms are seen in the cut-away side schematic views of FIG. 11, where FIG. 11A shows an embodiment where an egress area 48 is shared between a plurality of freezing cavities 40, FIG. 11B shows an embodiment where a dedicated egress area 48 for each freezing cavity 40 is provided, FIG. 11C shows an embodiment where an expanded egress area 48 relative to the freezing cavity 40 width is shared between a plurality of freezing cavities 40, and FIG. 11D shows an embodiment of a single expanded egress area relative to the freezing cavity 40 width having angled walls shared between two or more freezing cavities. The expanded and angled egress area embodiment of FIG. 11D has the added advantages of utilizing the angled bend as the fill line 47 and easing in the removal of the frozen ice as the angled walls provide more space for the ice to be removed.

If the egress area 48 is undersized, a significantly higher percentage of impurities could be retained by the ice, making it less clear and pure as well as faster melting. An oversized egress area 48 may extend the ice generation cycle as more energy may be required to lower and maintain the temperature near the freezing temperature. The egress area 48 also must allow sufficient room for mixing mechanism 31 to be submerged and come in sufficient contact with the water while still allowing enough room for the ice form to grow to its specified height. The space between the top water line of egress and top of tray 16 should be large enough such that the system does not overflow when the mixing mechanism is submerged into the tray and/or volume changes during solidification and/or when the user removes the tray 16 from the ice machine 10 and purges the water. The tray 16 can have minimum and maximum fill line features to guide the user on how high to fill the tray 16; overfilling the tray could result in spillage while underfilling the tray could result in cloudy ice. Additional embodiments may use sensing to confirm the water level height is appropriate or have an automated filling apparatus which does not require the user to fill the tray 16 but rather a separate reservoir.

To reduce friction from the user experience, a number of features could be added to the tray 16. Sensors or components on the tray 16 that interact with sensors on the ice machine 10 could better help communicate the status of the ice machine 10 and/or process. For example, a magnet or piece of steel integrated into the tray 16 can interact with a hall effect sensor or inductive sensor on the ice machine 10, so the ice machine 10 could know if the tray 16 is inserted or not. This approach could also be taken to understand the water level in the tray 16 and notify the user if they have underfilled or overfilled the tray 16. This approach could also be taken to understand the ice level in the tray 16 and notify the ice machine 10 when it has reached a particular point.

Heat Pump Configurations

Figure 12D:
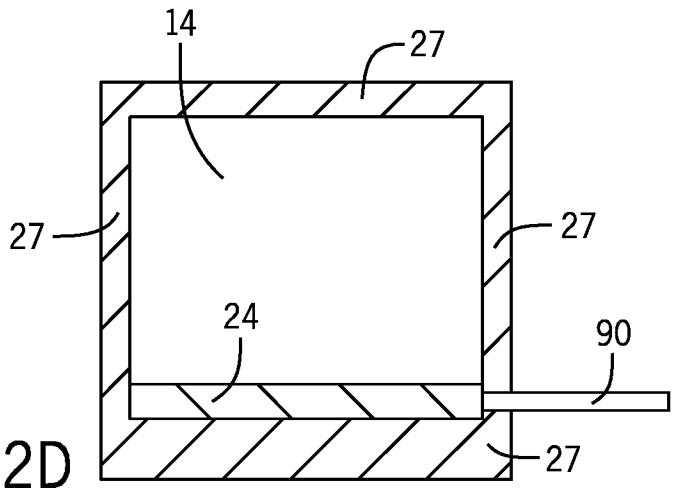
FIG. 12D shows a cut-away side schematic view of an example of an alternative heat pump and cold plate in accordance with the principals of the present invention.
Figure 12A:
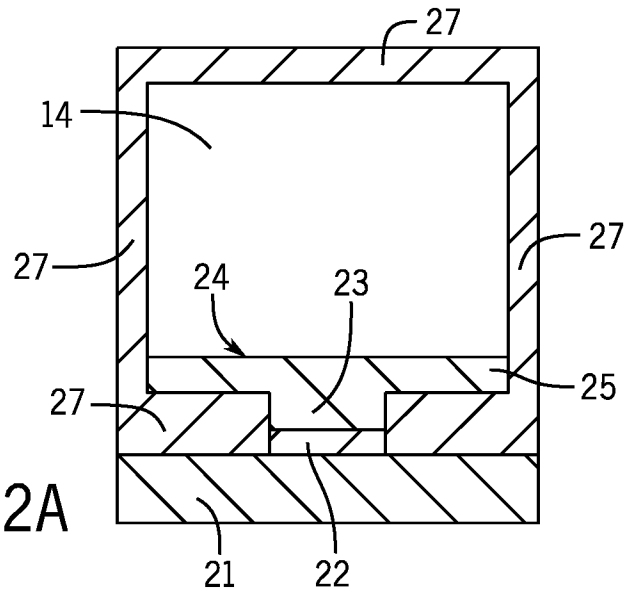
FIG. 12A shows a cut-away side schematic view of an example of a single TEC element in accordance with the principals of the present invention.
Figure 12C:
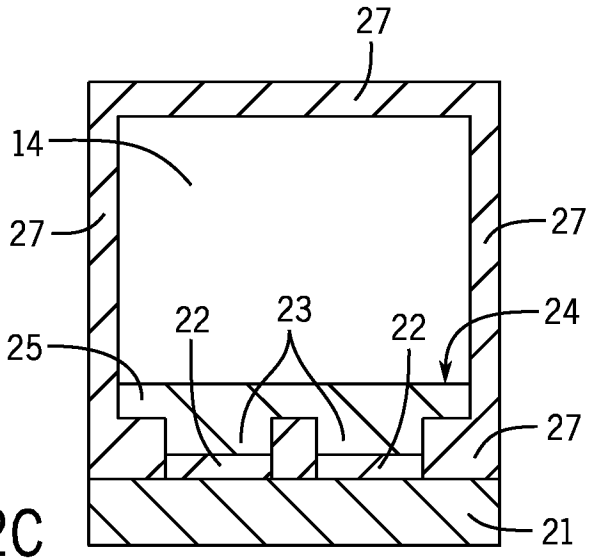
FIG. 12C shows a cut-away side schematic view of an example of two or more TEC elements in accordance with the principals of the present invention.

As previously discussed, the heat pump configuration plays a noteworthy role in the formation of the ice. If used to freeze multiple freezing cavities 40 of larger cross-sectional (XY axis) area, heat pump configuration can impact the shape of the final ice form and rate of growth. Referring to FIG. 12, cut-away side schematic views of examples of various heat pump configurations and cold plates 24 acting as energy transfer surfaces of the heat exchange 12 are seen, where FIG. 12A shows a single TEC element 22 heating the pedestal 23 of the cold plate 24 in accordance with the exemplary embodiment described herein, FIG. 12B shows an embodiment with a single TEC element 22 cooling the pedestal 23 of the cold plate 24 having a side walls 26 that extend upwardly along the freezing/mixing chamber 14, FIG. 12C shows an embodiment with two TECs, and FIG. 12D shows an embodiment with a refrigerant system 90 connected to the cold plate 24, potentially more applicable to a larger commercial embodiment than a consumer kitchen appliance sized embodiment. The exemplary embodiment described herein contemplates use of a single larger, more powerful TEC element 22. This simplifies the design, is cheaper, and reduces the number of components. Alterative designs can include a single TEC with a modified energy transfer surface, use of a plurality of TECs, and alternative placements of the TECs and/or refrigerant system relative to the energy transfer surface. In simulation, the temperature variance across a five-inch (15 centimeters) by five-inch (15 centimeters) cold plate can be about 0°-8° C. (32°-46° F.). To compensate, the geometry defining surfaces 46 of the tray 16 and/or side walls of the ice machine 10 could be modified to conduct energy from the system such that at the final ice plane the flux is nearly identical at every XY-axis position.

Another approach could be to evenly distribute multiple, lower powered TECs across the cold plate to minimize temperature variance across the cold plate. This could increase the surface area to dissipate heat to the heat sink, enabling a less complex/expensive heatsink solution and/or smaller/quieter fan. This could also increase manufacturing volumes, lowering price. On the other hand, this approach requires more components, complicates assemble, and could create planarity issues; however, given a particular ice machine design the tradeoff might be worth it for the performance improvements. This solution can also be much more scalable with ice form quantities and shapes, as only the position of the TECs under the cold plate need to be optimized. An embodiment where there are a plurality of freezing cavities contemplates placing one TEC directly underneath each freezing cavity.

Mixing

As previously discussed, the mixing mechanism plays a noteworthy role in the formation of the ice. Mixing is an important element to the clarity, growth rate, and shape of the ice form. The purpose of the mixing mechanism 31 is to create a velocity profile at the water/ice interface. This velocity profile helps wash away impurities in the water, enabling more pure crystal growth.

Depending on the implementation of the mixing mechanism 31 in a particular embodiment, the velocity created/controlled and/or position may change as a function of time, process temperature, ice height, and/or some other variable. To achieve clear ice there is a minimum velocity profile needed at the water/ice interface. This velocity profile is dependent on the energy flux through the boundary layer: More flux means higher velocity is needed to keep up with growth rate and maintain clear ice; as ice grows taller, flux typically is less as a function of ice height, thus lowering the velocity needed at the boundary layer. No mixing can lead to cloudy ice; some mixing can lead to clear ice on top where the flux is smaller than the flux on the bottom. There is some minimum velocity needed to achieve clarity at the bottom of the tray. This velocity may be exponentially or linearly greater than what velocity is needed at the end of the ice generation cycle. Varying the mixing mechanism 31 based on the status of the ice formation either as a function of time, height or through use of other sensors could be advantageous for speeding up ice growth while maintaining ice clarity. A high velocity profile and low flux could result in little, no or negative growth (energy input by device is greater than energy removed at water/ice boundary layer and the surrounding system).

The well/freezing cavity 40 size, shape, orientation, and quantity are drivers for the design and control of the mixing mechanism 31. The described exemplary embodiment uses a DC motor with an axial style impeller attached, better known as an axial impeller mixer. This type of mixer is good for bringing fluid in from the same plane and directing it perpendicular and vice-versa. For usability in the exemplary embodiment of the ice machine 10, this mixing mechanism 31 can be in a fixed position but to insert the tray 16, this mixing mechanism 31 should have some ability to move in the Z direction. When "open" the mixing mechanism 31 should be out of the way, allowing the users to insert the tray 16 and when "closed" the mixing mechanism 31 would be submerged into the water of the egress area 48. The convection can contribute to the final ice form. Ideally at any given height of water/ice boundary layer there could be a constant and consistent velocity profile. In reality this is difficult to achieve. As discussed above, depending on flux and mixing, growth rate can vary, thus the top of the ice may not be completely planar but would be substantially "flat" such that the curvature of the surface is satisfactory for the desired aesthetic appeal.

Velocity can be created by a number of different mixing mechanisms 31 each with pros and cons. The main attributes are a range of fluid velocity, directionality of fluid velocity, energy dissipated into the system, form factor, and cost.

These include but are not limited to the following: Mixers—typically motor with shaft attached and impeller at the end, axial, radial, magnetic stirrer, combination; pumps—such as positive displacement pump (diaphragm, gear, peristaltic, solenoid, etc.); axial flow pump; centrifugal pump; vibration, ultrasonic or other; and fans—flow air across egress.

These mixing mechanisms 31 can be configured in a number of different ways. These mixing mechanisms 31 can be fixed relative to the energy transfer surface 42 above some height of the final ice form or move to remain at a fixed position with the water/ice boundary layer (telescope implementation) or some combination in between. An example of this is shown in the cut-away side schematic views of the ice machine of FIG. 13, where FIG. 13A shows the exemplary embodiment with a mixing mechanism 31 in the fixed position and FIG. 13B shows an embodiment with a variable mixing mechanism 31 utilizing a telescopic fixture 93.

Figure 13A:
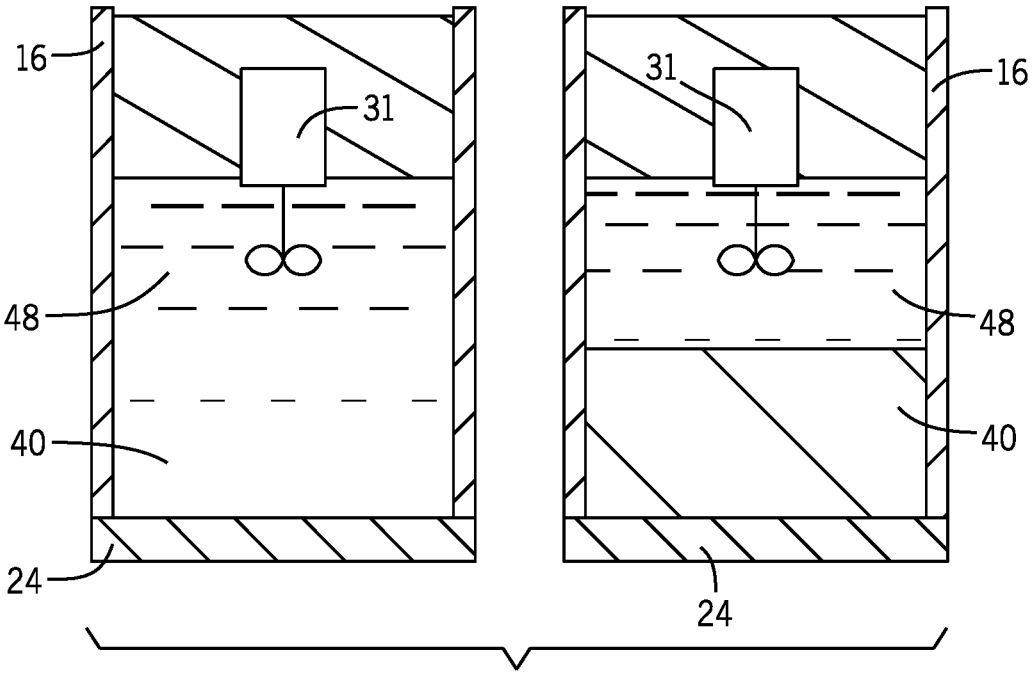
FIG. 13A shows a cut-away side schematic view of an example of a mixing mechanism in a fixed height position in accordance with the principals of the present invention.
Figure 13B:
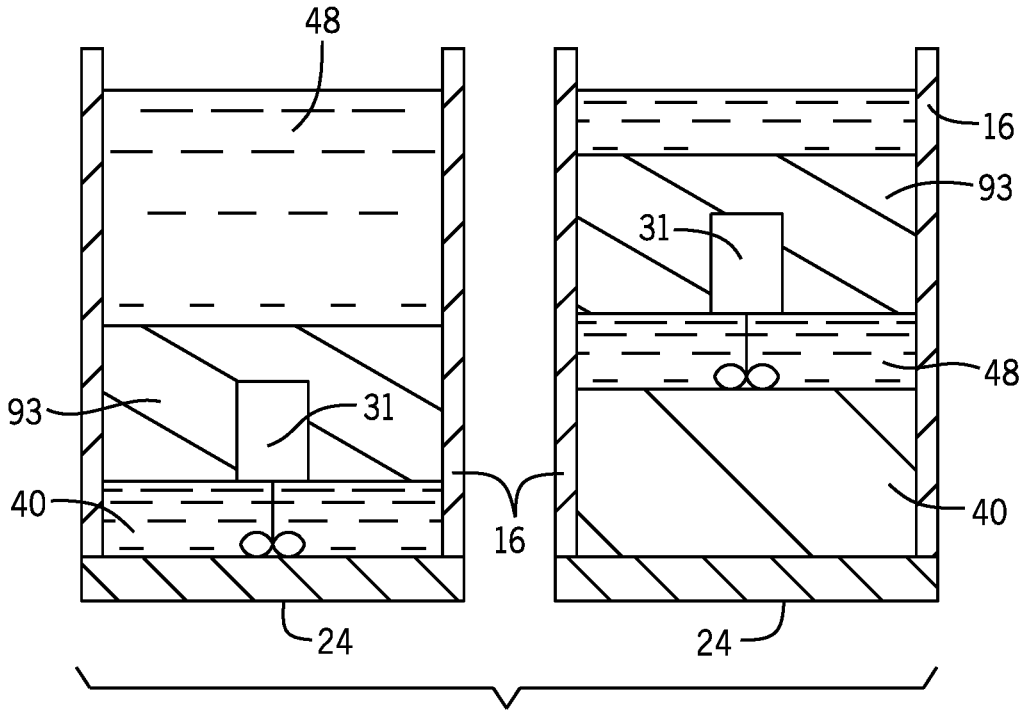
FIG. 13B shows a cut-away side schematic view of an example of a variable height mixing mechanism utilizing a telescopic fixture in accordance with the principals of the present invention.

While depending on the specific application use of fixed or variable mixing configurations are within the principals of the present invention, in the exemplary system of a consumer kitchen appliance sized ice machine in accordance with the principals of the present invention utilizing a fixed mixer in accordance with FIG. 13A provides an adequate mixing profile.

Figure 14C:
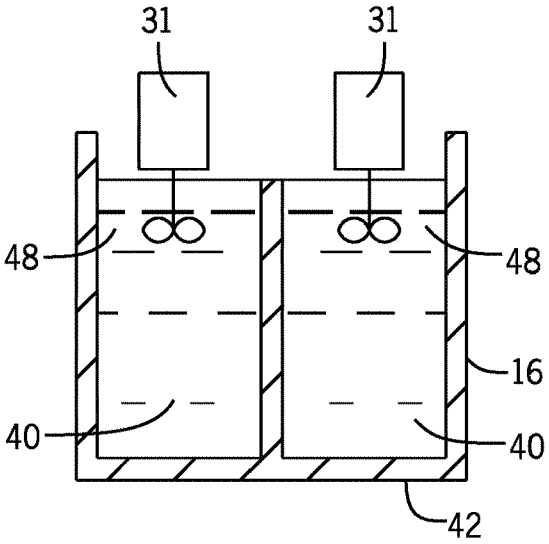
FIG. 14C shows a cut-away side schematic view of an example of a mixing mechanism in each freezing cavity in accordance with the principals of the present invention.
Figure 14B:
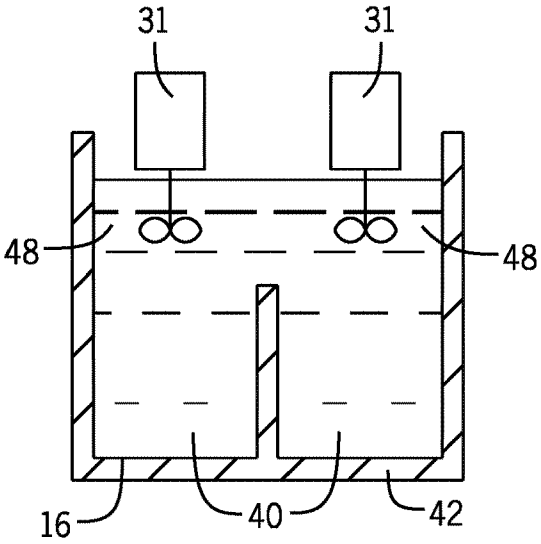
FIG. 14B shows a cut-away side schematic view of an example of a mixing mechanism in an egress area over each freezing cavity in accordance with the principals of the present invention.
Figure 14A:
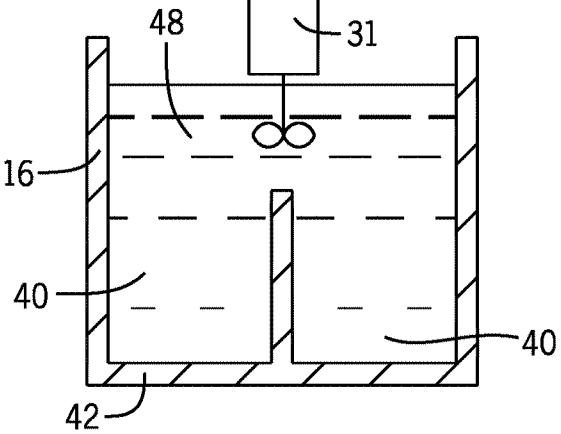
FIG. 14A shows a cut-away side schematic view of an example of a mixing mechanism centered in an egress area over multiple freezing cavities in accordance with the principals of the present invention.

There could be one mixing mechanism 31 per freezing cavity 40 egress area 48 and/or multiple mixing mechanisms 31 per freezing cavity 40 and egress area 48. The mixing mechanism(s) 31 can also be positioned over each freezing cavity 40 of the tray 16 or for efficiency purposes, straddle between multiple freezing cavities 40 at once. Examples are shown in the cut-away side schematic views of the tray of FIG. 14, where FIG. 14A shows the exemplary embodiment with a mixing mechanism 31 centered in the egress area 48 over multiple freezing cavities 40, FIG. 14B shows an embodiment with two mixing mechanisms 31 in the egress area 48 over multiple freezing cavities 40, and FIG. 14C shows an embodiment with a mixing mechanism 31 in dedicated egress areas 48 over multiple freezing cavities 40. Each mixing mechanism 31 could be independently driven or multiple mixing mechanisms 31 could all be coupled together (for example a system of gears).

While depending on the specific application use of such various mixing configurations are within the principals of the present invention, testing has shown that in the exemplary system of a consumer kitchen appliance sized ice machine in accordance with the principals of the present invention a flow pattern created by utilizing a single mixing element for multiple freeze cavities in accordance with FIG. 14A should deliver similar velocity profile to each freezing cavity.

Figure 15C:
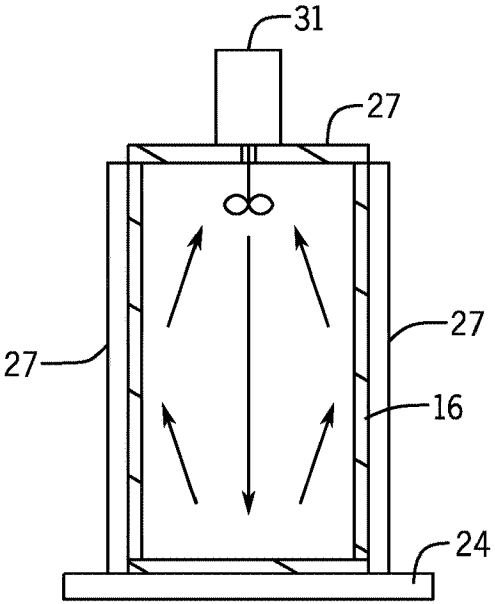
FIG. 15C shows a cut-away side schematic view of another example of an alternative flow configuration resulting from example mixing mechanism placements in accordance with the principals of the present invention.
Figure 15B:
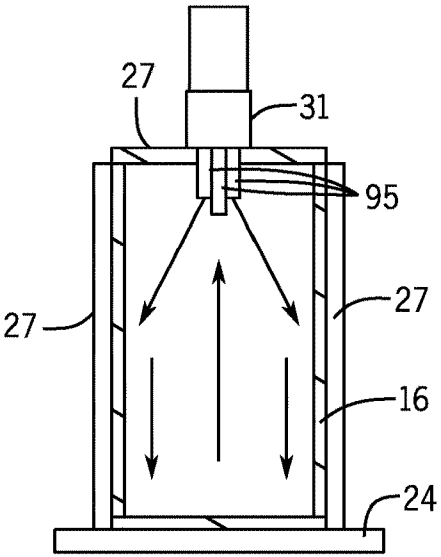
FIG. 15B shows a cut-away side schematic view of an alternative flow configuration resulting from example mixing mechanism placements in accordance with the principals of the present invention.
Figure 15A:
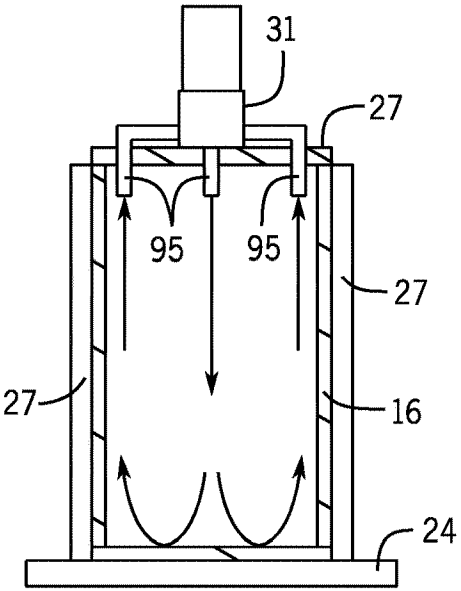
FIG. 15A shows a cut-away side schematic view of a flow configuration resulting from example mixing mechanism placements in accordance with the principals of the present invention.
Figure 15D:
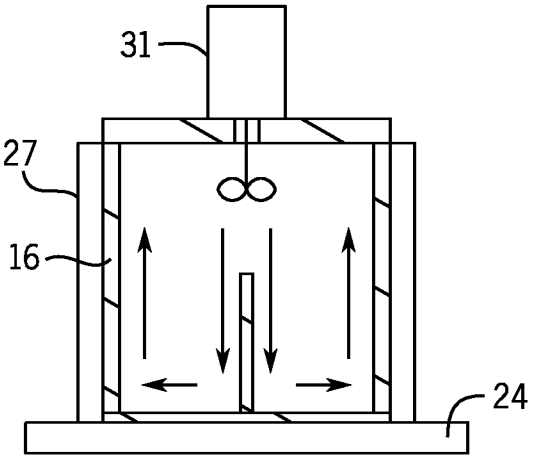
FIG. 15D shows a cut-away side schematic view of another example of an alternative flow configuration resulting from example mixing mechanism placements in accordance with the principals of the present invention.
Figure 15E:
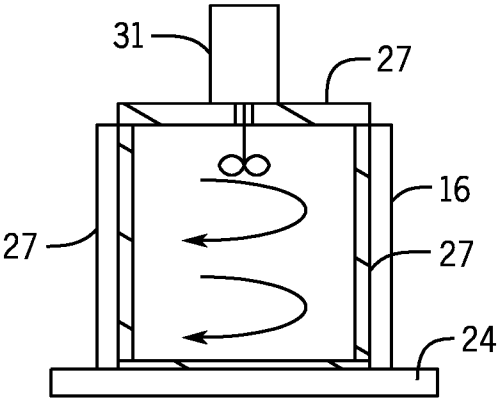
FIG. 15E shows a cut-away side schematic view of another example of an alternative flow configuration resulting from example mixing mechanism placements in accordance with the principals of the present invention.
Figure 15F:
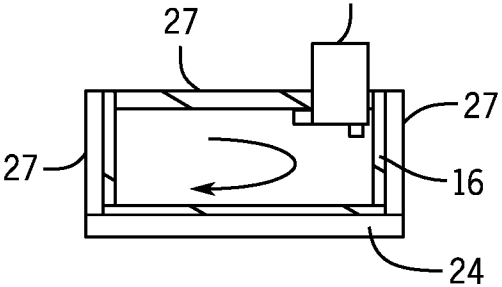
FIG. 15F shows a cut-away side schematic view of another example of an alternative flow configuration resulting from example mixing mechanism placements in accordance with the principals of the present invention.
Figure 15I:
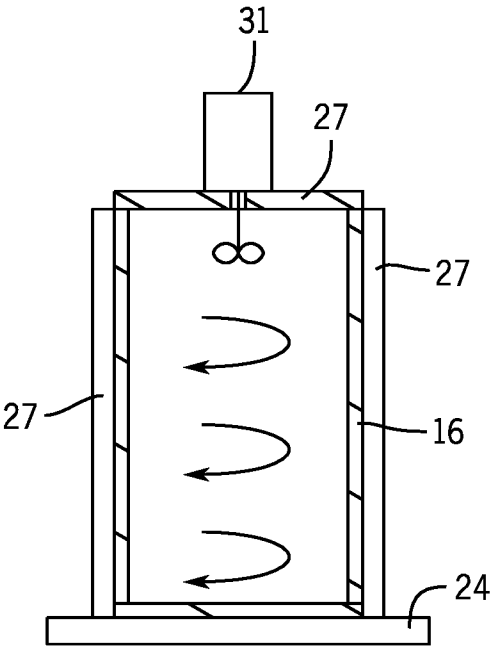
FIG. 15I shows a cut-away side schematic view of another example of an alternative flow configuration resulting from example mixing mechanism placements in accordance with the principals of the present invention.
Figure 15H:
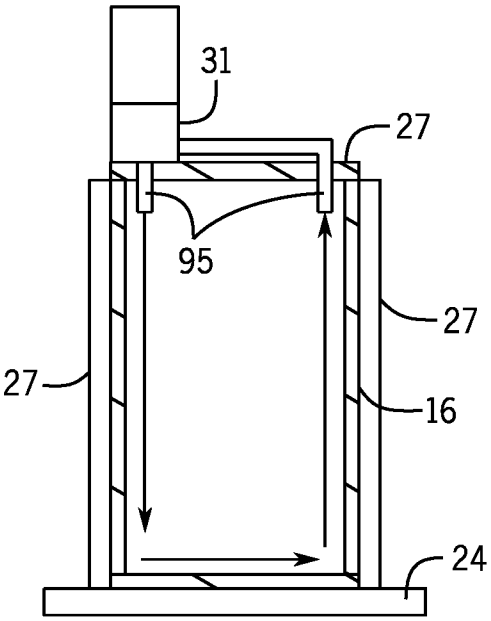
FIG. 15H shows a cut-away side schematic view of another example of an alternative flow configuration resulting from example mixing mechanism placements in accordance with the principals of the present invention.
Figure 15G:
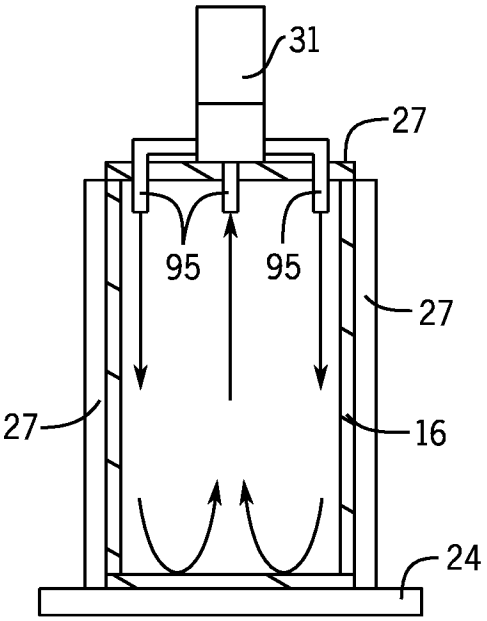
FIG. 15G shows a cut-away side schematic view of another example of an alternative flow configuration resulting from example mixing mechanism placements in accordance with the principals of the present invention.

The aspect ratio (height relative to XY-axis footprint) and/or number of freezing cavities per mixing mechanism can also play a role in the mixing mechanism 31 choice and configuration. Generally, there are two types that can be implemented: positive displacement and/or dynamic mixing/pump mechanisms. Generally high aspect ratio and/or multiple freezing cavities per mixing mechanism work well with a positive displacement mixer/pump to deliver the necessary velocity at the liquid/ice boundary layer. Generally low aspect ratio and/or single freezing cavities per mixing mechanism may only require a dynamic mixer/pump to deliver the necessary velocity at the liquid/ice boundary layer. For positive displacement pumps, the inlet and outlet of the water and velocity can be more tightly controlled. FIG. 15 shows cut-away side schematic views of the tray with examples of flow configurations resulting from different configurations of mixing mechanisms 31 that have pros and cons with shape and growth rate, where FIG. 15A shows an embodiment with the flow resulting from three spaced positive displacement pump nozzles 95 as the mixing mechanism 31 with the middle pump nozzle 95 exhibiting a downward displacement and the outer pump nozzles 95 exhibiting an upward displacement, FIG. 15B shows an embodiment with the flow resulting from three bunched positive displacement pump nozzles 95 as the mixing mechanism 31 with the middle pump nozzle 95 exhibiting an upward displacement and the outer pump nozzles 95 exhibiting a downward displacement (flow can be vice versa), FIG. 15C shows an embodiment with the flow resulting from a single impeller mixer as the mixing mechanism 31, FIG. 15D shows an embodiment with the flow (flow can be vice versa) resulting from a single impeller mixer as the mixing mechanism 31 positioned over multiple freezing cavities. FIG. 15E shows an embodiment with the flow resulting from a single impeller mixer as the mixing mechanism 31 designed to impart a circular fluid flow in a single ice freezing cavity, medium aspect ratio, FIG. 15F shows an embodiment with the flow resulting from a single centrifugal pump as the mixing mechanism 31 designed to impart a circular fluid flow in a single ice freezing cavity, small aspect ratio, FIG. 15G shows an embodiment with the flow resulting from three spaced positive displacement pump nozzles 95 as the mixing mechanism 31 with the middle pump nozzle 95 exhibiting an upward displacement and the outer pump nozzles 95 exhibiting a downward displacement, FIG. 15H shows an embodiment with the flow resulting from two spaced positive displacement pump nozzles 95 as the mixing mechanism 31 with one exhibiting a downward displacement and the other exhibiting an upward displacement, and FIG. 15I shows an embodiment with the flow resulting from a single impeller mixer as the mixing mechanism 31 designed to impart a circular fluid flow in a single ice freezing cavity, high aspect ratio.

While depending on the specific application use of such various flow configurations are within the principals of the present invention, testing has shown that in the exemplary system of a consumer kitchen appliance sized ice machine in accordance with the principals of the present invention utilizing an axial style (as opposed to radial or other type) impeller to draw water up or push water down through center of the tray in accordance with FIG. 15D is utilized.

In additional embodiments, part or all of the mixing mechanism 31 may be integrated into the removeable tray 16. In one example, a magnetic stir bar could be integrated into the tray 16 and with a cooperating feature on the ice machine 10 that spins, enables the magnetic stir bar to rotate. In another embodiment, the impeller could be integrated into the top of the tray 16 and have a gear attached at the top of the shaft that could mesh with a gear on the ice machine 10 side. In another embodiment, the tray 16 assembly may have the mixing mechanism 31 integrated into it and could be battery powered or electrically connected to the ice machine 10 (i.e. pogo pins).

Sensors

As previously discussed, an ice machine in accordance with the principals of the present invention can utilize controls/sensors for various purposes, such as to sensing top door position, sensing the tray presence, sensing liquid level, sensing unsafe conditions, and sensing completion of the ice generation cycle. Additional controls/sensors can be provided in additional embodiments of various ice machines in accordance with the principals of the present invention.

Such controls/sensors can include maintaining the ice at a pre-determined height until the user retrieves the ice. The need to maintain the ice may arise if at end of the ice generation cycle, the user is not present to retrieve the ice. To maintain the ice, the cold plate can be targeted at a maintenance temperature by modulating the TEC element power and/or fan speed while still keeping the mixer engaged at a low or high speed for a set period of time. This "hold" time can be determined through trial and error and may be anywhere from an hour or days theoretically. One potential risk is the ice freezes into the impeller region; this could cause the impeller to get stuck and/or the impeller could open up the top. In either scenario, current sensing on the motor can determine if impeller is stopped and door sensor could determine if lid pops open. If the user does not harvest the ice within the specified amount of time, the machine can end the ice generation cycle or go into a safety mode. This ice maintenance feature is an improvement over molds which require the user to check on ice periodically (inconvenience), ice machines that eject the ice from the mold and place the ice into a storage container for the user to retrieve at their convenience (ice forms can sinter together and be a pain to remove), and ice machines which rely on a time-based system (can lead to under or overgrowth). From a usability and/or machine capability perspective, it may be advantageous to have a timer enabled such that the user must harvest their ice within a set time of the ice generation cycle ending. The machine will communicate through the user interface that the ice is ready to harvest.

One sensing mechanism is temperature, either directly or indirectly. If temperature is measured directly, usability could be an issue as the temperature sensor could get frozen into the ice. Measuring indirectly through the tray or other feature has its advantages and disadvantages. One challenge is the measurement lag and sensitivity at the same height within and outside the tray. The controls may need to have some correction factor for thermal lag. Placing the sensor in the water has pros for measurements responsiveness but could impact the ice shape and/or reliability of the ice machine. Another challenge to be accounted for is good thermal contact between the surface to be measured and the sensor. This can be done a number of ways, including proper tolerancing of the system to ensure good contact between ice machine and tray and/or features that can be deflected by the tray when inserted or features integrated in the tray or ice machine that facilitate thermal transfer when alignment is not perfect.

Other sensing mechanisms such as for example capacitance sensing could also be used as a non-contact solution to determine the height of the ice by tracking either the ice, water, air and/or some combination thereof. Water, ice, and air all have different electrical properties, which can be discerned by a capacitive sensor that is designed and tuned properly. Some challenges with this sensor include time to develop and tune, interference from other electrical elements like motor drivers and/or condensation/freezing on or around the sensor that could produce a false positive reading. Time of flight sensors such as radar, ultrasonic/sonar, laser level, infrared (IR), Lidar could be used as a non-contact solution to determine ice height. Such sensors could be located on the top/side of the freezing/mixing chamber or some of these solutions could be submerged in the water to directly measure the top surface of the ice form.

Impurity measurement can also be an indirect way that the height of the ice could be determined. Over time, if the process is working properly, a probe located in the egress area of the tray in contact with the water could measure the concentration of impurities. This increase in impurities, either absolute or relative, could be correlated back to the height of the ice. This method can be dependent on the impurity concentration in liquid placed into the system; to address this the ice machine could have the ability to filter the water and ensure the water is always at some minimum and/or maximum impurity concentration to enable more accurate and consistent results.

Volume change is another indirect way to measure ice height using either a non-contact time of flight sensor and/or float system that comes in contact with the water. Ice is less dense than water, thus over the course of the freezing cycle the volume occupied by the water/ice increases (resulting in a water level change in the egress). For a small tray the difference may be insignificant but for a large tray it may be possible to accurately measure these differences and correlate them back to the height of the ice.

Physical contact with the ice could also be made to determine its height. In one implementation, a probe could go down into the tray and stop at a certain resistance. This resistance could be measured through a strain gauge, current or some other mechanism. Another approach could be coupling a sensor to the mixing mechanism and having freedom of motion in one axis. As the ice grows, and the mixing mechanism creates some minimum threshold of mixing, the mixing mechanism could translate up with the ice growth instead of being frozen into it. This translation could be detected.

Another indirect method to measure ice height could be the cold plate temperature and/or heat exchanger hot side temperature and/or the current/voltage draw of the heat pump. One challenge, like the impurities sensor, is the environment (i.e., air temperature, air flow, etc.) cannot be controlled and this impacts heat pump performance, which could impact potential thresholds. To overcome, an absolute, relative and/or change in value overtime in different environments could be measured to correlate specific ice heights with performance. Another option is to measure the current on the mixer. If the mixer is set at the desired ice height and allowed to freeze, the mixer could stall, significantly increasing the current draw relative to the steady state draw. This information could be relayed back to the ice machine to stop ice production; however, the mixer could have to be unfrozen before the user could remove the tray.

Additional sensors could be implemented in the tray or ice machine to improve the user experience including the ability to sense water temperature, water impurities, water level, and other items. All the aforementioned sensors and configurations could be used independently or in some combination.

Additional Process Design Considerations

As previously discussed, while the exemplary system in accordance with the principals of the present invention described herein is generally representative of a consumer kitchen appliance sized ice machine, the system can be scaled up or down to have higher or lower throughput and efficiency as well as larger or smaller ice forms. Depending on the desired characteristics, in designing ice machines in accordance with the principals of the present invention process considerations require the coordination and design of elements to work in unison/combination. Growth rate/clarity optimization can be done via a controlled or uncontrolled process. Some minimum velocity is needed at the water/ice boundary layer to help wash away impurities as the ice grows. This minimum velocity is dependent on the energy flux at the water/ice boundary layer: A higher energy flux requires a higher velocity at the boundary layer and vice versa to achieve adequate growth with sufficient clarity; providing too low of velocity at a high energy flux layer could result in cloudy ice (for example, impellers may not be a good fit for high aspect ratio molds—see, for example, FIG. 15C); too high of velocity in a low energy flux layer could result in little, no or negative ice growth (for example, positive displacement pumps may not be a good fit for low aspect ratio molds—see, for example, FIG. 15B). This relationship between energy flux and velocity could have a linear, exponential, and/or polynomial relationship. If the mixing mechanism is at a fixed position relative to the energy transfer surface, the mixer velocity is not necessarily one for one with velocity at the water/ice boundary due to losses in the system and may need to be compensated for accordingly.

As previously discussed, using a controlled process, sensors (such as temperature or capacitance) can be used to determine the height of the ice. This information can be relayed back to a microcontroller that could adjust a component such as the cooling and/or mixing mechanism rate depending on the height of the ice or some other variable in the system. Using an uncontrolled process, the system could adjust a component such as the cooling and/or mixing mechanism rate as a function of time based on initial starting condition either detected by the ice machine (for example, water temperature and/or air temperature) or input by the user (dial to increase/decrease freeze time, tray type/size, etc.).

One issue that has been observed during testing is the buildup of thermal stress in the ice, producing fractures before or during the harvesting cycle. This has been observed in high aspect ratio, all metal molds where a "pop" happens during the cooling cycle. When the ice form is removed, there stress fractures can be formed throughout the ice. This phenomenon has also been observed with ice taken directly out of a home freezer and liquid poured over it. Cracking of the ice typically occurs due to thermal stress and quick change in temperature. Therefore, care must be taken in designing trays having a metal component when utilized in high aspect ratio freezing cavities.

Another issue that has been observed is the flatness of the top surface of each ice form. In an ideal system with energy being evenly drawn from the bottom and no losses out the sides or top, the ice could grow planar with the cooling surface. In the real world, a perfectly insulated ice machine and evenly distributed cold plate is not possible. A number of ways can be utilized with hardware, process, and/or post processing to mitigate or eliminate this issue.

A dome shaped top surface on the ice cubes results from a system where there was energy gain from the sides/top and/or more energy drawn from the center of the cold plate than the outer edges. One way to fix this issue could be to have conducting surfaces along the side of the tray. If not tuned properly, a bowl-shaped surface on the ice cubes can be created.

A flatter top surface on the ice cubes could be achieved by cutting the geometry defining surface length in half. The energy transfer surface material, shape, and thickness can be adjusted on the ice machine or tray side to help mitigate this flatness issue. Other hardware solutions could include increasing the insulation around the system, strategically organizing thermoelectric coolers or refrigeration below the cold plate, designing the cold plate to evenly distribute energy, adjusting the mixing mechanism and its flow path, adding energy pumping devices along the height of the tray, and/or some other combination therein.

The aspect ratio and mixing mechanism also plays a role in the planarity and shape of the top ice layer. For the exemplary embodiment described herein, the aspect ratio of the mold will be low in conjunction with a mixer with an impeller. This impeller will be optimized for creating sufficient velocity as well as creating a flat top surface. Impellers can struggle to drive fluid downward when positioned towards the top of high aspect ratio molds, making impellers less suited for that configuration. Positive displacement pumps work well in high aspect ratio molds, particularly those where the pump needs to be positioned above the water reservoir. High aspect ratio molds with a length or width dimension of two inches (five centimeters) or smaller tended to yield a parabola shape in the final cube. This can result in ice waste or efforts to flatten the top surface. Low aspect ratio molds may yield uneven top surfaces that may be inconsequential to the end user. A parabola shape can be created when the ice form is a high aspect ratio and there is cooling on the side walls. Where the inlets and outlets of the mixing mechanism are placed can also impact the top surface shape: If too close to mold walls, ice can freeze up and stop flow, resulting in cloudy ice.

Some process steps can be adjusted to help address ice flatness. Reducing flow or changing direction as the ice grows could be advantageous. Adjusting when and where energy is extracted from the system could also be advantageous. There are also some post processing options that could occur inside or outside the ice machine. One example could be a press that comes down and melts the top surface until it is flat. Another example could be a cutting or machining tool that flattens the top surface. Another example could be to strategically add heating elements on the side or top of tray and/or in the water to add energy to areas that have too much grown.

Another process issue that could arise if the tray becomes frozen to the cold plate and/or stuck to the side walls of the freezing/mixing chamber due to expansion of the ice. This may require a special removal process automatically initiated by the ice machine at a certain time and/or when the door is opened by the user and/or initiated by the user at the end of an ice generation cycle. Examples of such processes could include running the TEC element at lower power, turning the TEC element off completely, and/or flipping the polarity of the TEC element such that the cold side becomes the hot side and slightly melts the ice to release the tray.

Another process issue could be timely communication with the user regarding ice cycle status. In an embodiment, the machine may have no connectivity and only communicate through the onboard user interface. In another embodiment, the machine could connect to Wi-Fi or Bluetooth, enabling a user through their electronic device to check in on cycle status, control/configure the machine remotely, and be notified when there is an error or action needed such as harvesting the ice.

Ice Production Inserts

The technology described above freezes a tray of water from the bottom up in order, inter alia, to yield a substantially clear ice form with a lower concentration of impurities. Freezing from the bottom up, versus the top down like a lake during the winter, presents unique challenges. It is difficult to create the first layer of ice and maintain clarity. Clear ice is created by a combination of directional freezing and mixing. To start making ice, a nucleation site and seed crystal are necessary. When water transitions from a liquid to a solid, it becomes less dense. The upwards buoyancy force on this less dense ice and the mixing inhibit nucleation/seeding on the bottom surface of the tray. This creates a supercooling effect that ultimately results in cloudy ice.

Supercooling occurs when the temperature of a liquid goes below its freezing point without becoming a solid. This can happen when there is no seed crystal to start the ice structure. From our observations, this supercooling can bring the water temp to 32° F. (0° C.) to 14° F. (−10° C.). At some point, either due to agitation or some other factor, the tray of water turns into a slushy mix. The top portion begins to re-melt due to the mixer but the bottom freezes, leaving about ¼ inch of cloudiness on the ice cube.

Originally, it was thought that this problem could be solved with higher surface energy materials, different surface morphology, and/or process parameters. Materials and morphology were tested by cutting small squares of different materials with different textures and securing them to the bottom of the trays. Success was seen with this approach, so trays were constructed out of each material. These materials included silicone, silicone plus surface enhancer, and two different thermoplastic elastomers. It was thought that if the tray was made of similar material that worked as an insert, a tray composed of solely that material would also work. Unfortunately, seed/nucleation was not achieved without the supercooling effect.

Next, different textures and patterns of varying aspect ratios (e.g., VDI-2 (promulgated by Verein Deutscher Ingenieure e.V., VDI-Platz 1, 40468 Dusseldorf, Germany), a cross-hatch pattern with approximately 1 mm walls) were added to the bottom surfaces of the trays. Unfortunately, seed/nucleation was not achieved without supercooling effect or significantly compromising the surface finish of the cube.

Process modifications were also tested. These included stopping mixing, mixing faster, and pulsing mixing at various times. When mixing was stopped, nucleation could begin on the bottom of the tray; however, this yielded a small layer of cloudy ice. Mixing faster still led to supercooling, but had the ability to re-melt ice. Mixing faster also led to a small layer of cloudy ice on the bottom and also was extremely loud from a user experience perspective. By pulsing the mixer, the hope was that the stagnant times enabled nucleation/seeding to initiate on the bottom and the mixing times would enable the ice to remain clear on the bottom layer. In some instances, this approached worked; however, the level of process control needed to execute across many trays and machines would prove difficult.

In this testing, the only time clear ice was able to be made without supercooling was with inserts, thin sheets of material held in place with glue or friction at the bottom of each tray/cavity. It is now theorized that it was not necessarily the material or the morphology of the insert, but rather the ability of the insert to trap or significantly hinder the movement of water underneath and around the edges of the inserts that surprisingly resulted in improved clarity of the ice.

Figure 16:
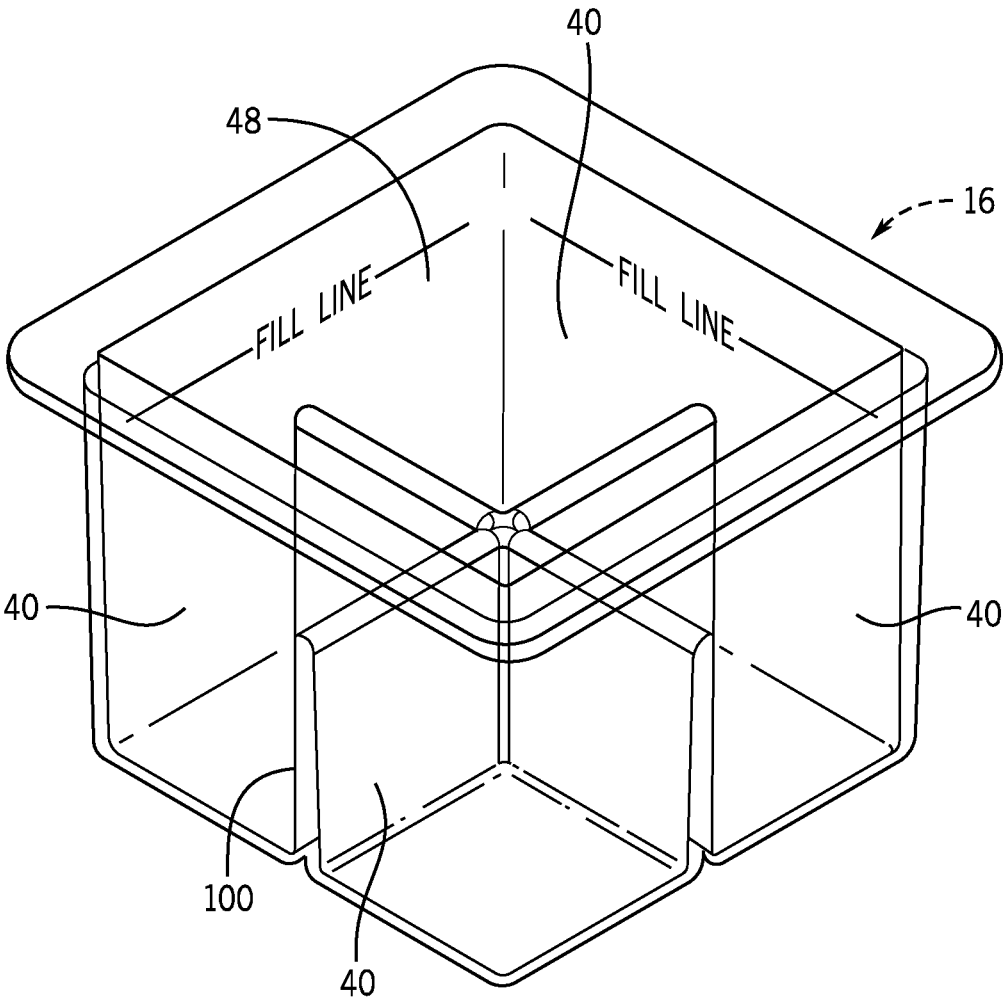
FIG. 16 shows a perspective view of an example ice production insert in accordance with the principals of the present invention.

It is theorized that two phenomena could be happening, either in tandem or separately, due to the use of inserts at the bottom of a tray cavity. For context, FIG. 16 shows a perspective view of an example tray 16 having multiple cavities 40, and a single, removeable insert 100. More detail on the insert 100 of FIG. 16 is provided, below.

Figure 17A:
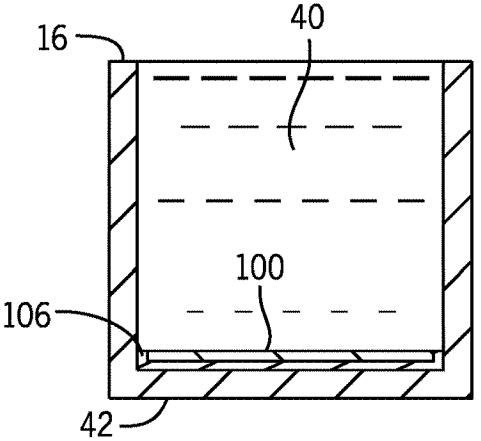
FIG. 17A shows a cut-away side schematic view of an example tray with a single cavity filled with water and an example insert in accordance with the principals of the present invention.
Figure 17B:
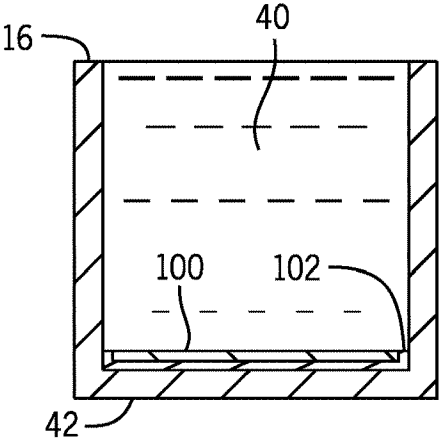
FIG. 17B shows a cut-away side schematic view of the tray and insert of FIG. 17A with trapped, stagnant water freezing first.
Figure 17C:
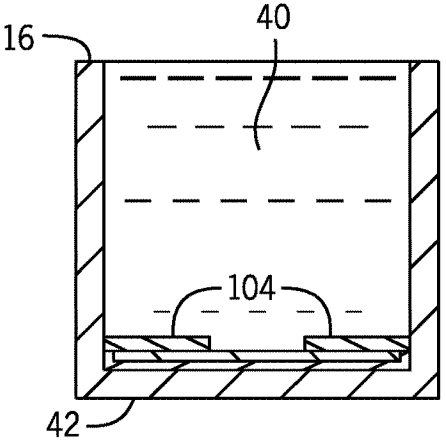
FIG. 17C shows a cut-away side schematic view of the tray and insert of FIG. 17A with clear ice growing from the edges.
Figure 17D:
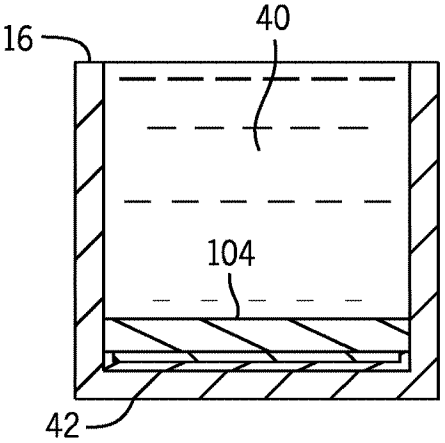
FIG. 17D shows a cut-away side schematic view of the tray and insert of FIG. 17A with the clear ice covering the XY surface area of the cavity insert.
Figure 17E:
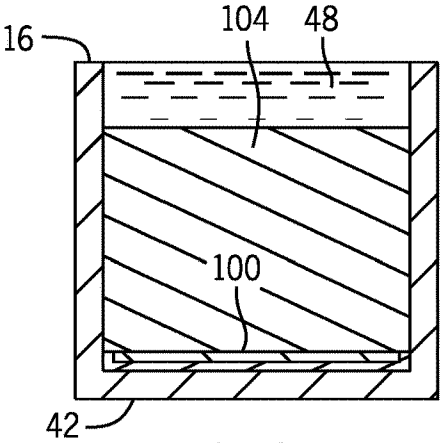
FIG. 17E shows a cut-away side schematic view of the tray and insert of FIG. 17A with the clear ice grown to the desired height.
Figure 17F:
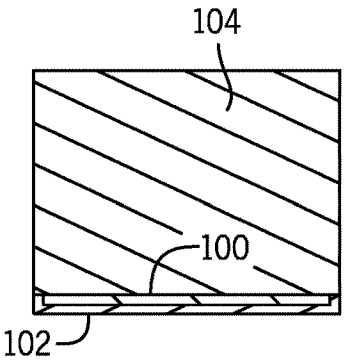
FIG. 17F shows a cut-away side schematic view of the insert and ice of FIG. 17E removed from the tray.
Figure 17G:
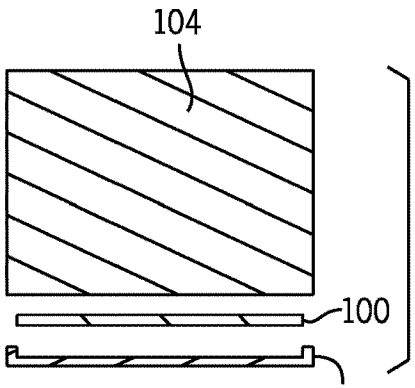
FIG. 17G shows a cut-away side schematic view of the removed insert and ice of FIG. 17F with the insert separated from the clear ice and sacrificial volume of cloudy ice.

FIG. 17A shows a tray 16 with a single cavity 40 filled with water and an insert 100 situated at the bottom, roughly spanning the bottom XY surface. The insert 100 can have an outer circumference that is slightly less than the inner circumference of the cavity 40 to define a slight gap to expose edges 106 of the insert 100. There is a small volume of water 102 that gets trapped between the insert 100 and the bottom energy transfer surface 42 of the tray 16/cavity 40. FIG. 17.B shows this trapped stagnant water 102 freezing first. This newly formed ice 102 is cloudy, but is separated by the insert 100 from the main volume of water in the cavity 40. Small opening near the edges of the insert 100 act as the nucleation/seed site for the main volume of water. In this case, since ice has already established itself at the bottom of the tray 16, mixing continuously runs to ensure clear ice is made above the insert 100. As shown in FIGS. 17C and 17D, clear ice 104 grows from the edges until the XY surface area of the cavity insert is covered. The insert 100 remains as a barrier to the cloudy, sacrificial volume of ice 102 and the newly formed, clear ice 104 above. This clear ice growth continues, as shown in 17E, until the desired height is achieved. At the end of the process, the sacrificial volume 102, insert 100, and clear ice 104 can be removed from the tray 16 as seen in 17F. As seen in 17G, the insert 100 can then be separated from the clear ice 104 and the sacrificial volume of cloudy ice 102.

The insert effectively creates a no/low flow area beneath the insert and along the edges. The insert also limits the energy transfer through itself, as the thermal conductivity is two orders of magnitude less than ice. Therefore, the outer edges of the cavity cross section will grow faster than the center. The XY dimensions, thermal conductivity, and material thickness of the inserts can be adjusted to alter the energy transfer and high/low flow regions relative to the energy transfer surface and geometry defining surfaces of the cavities in the tray. Theoretically, this approach could also be executed where the low flow, high energy transfer area is not on the edges, but rather in the center and/or periodically throughout the XY cross section of the insert. This, however, may create some unintended surface finish issues on one side of the ice form.

A number of different means can be utilized to create a sacrificial volume and/or low flow/high energy transfer area at the bottom of a cavity. The feature/solution could also be alternatively shaped removeable object/s. Additional considerations for design include freeze time, user experience, durability, etc.

The initial embodiment is a removeable insert. FIGS. 18A-E show side views of a number of example potential insert 100 and tray 16 design combinations. Each insert 100 should not be limited by material, thickness, texture, etc. The first embodiment of inserts will be made of food safe PolyEthylene Terephthalate (PET) or comparable plastic with thickness ranging from about 0.1 mm to 2 mm. FIGS. 19A-F shows the top views of various example tray 16 and insert 100 combinations (in the absence of water), with the exposed edges 106 for seeding/nucleation identified. As discussed, small openings near the exposed edges 106 of the insert 100 act as the nucleation/seed site for the main volume of water, allow ice to form around it, growing clear ice from the edges to the center: less edges could increase the likelihood of providing inadequate seed sites leading to supercooling and thus generating cloudy ice. In addition to or as an alternative to the small openings near the exposed edges, the insert could define small holes to act as nucleation/seed sites. Each example design and the pros and cons of each are discussed in more detail below.

Figure 19A:
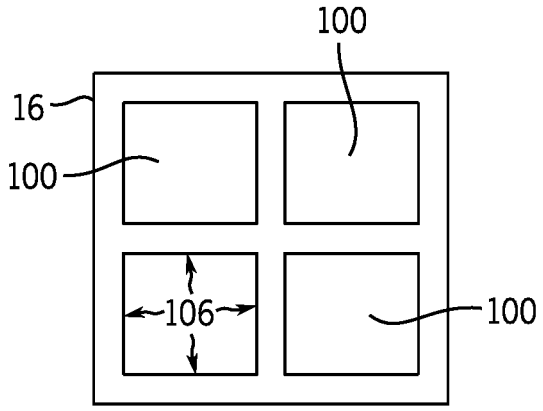
FIG. 19A shows an overhead view of an example four square cube freezing cavity configuration without water with four example inserts in accordance with the principals of the present invention.

FIG. 18A and FIG. 18B show a single insert 100 for each cavity. This design can come as a generally flat piece of plastic or metal as seen in FIG. 18A or can be on a pedestal 108 defining with an outwardly projecting lip 110 a stagnate mater area as seen in FIG. 18B to ensure sufficient water gets trapped underneath. The advantages to this design include that it is simple to manufacture, exposes the largest number of edges that ice can grow around—in the case of a cube, that would be four edges 106, as shown in FIG. 19A. Possible disadvantages might include that it could be difficult to install and keep in place, the inserts might be lost when removing from the tray, and the insert might sometimes be difficult to remove from the ice. To address some disadvantages, tabs could be provided that extend outward from the insert to slightly interfere with the tray to help hold the insert in place and also make the insert easier to separate from the final ice form.

Figure 19B:
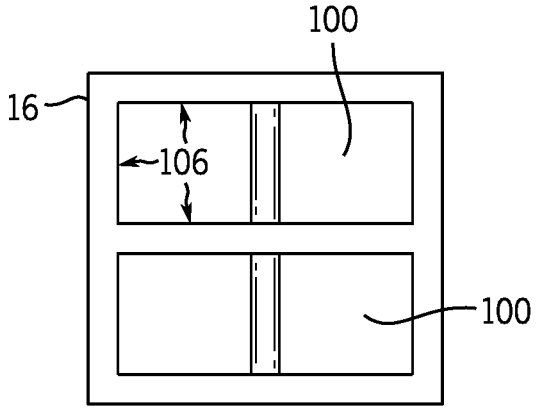
FIG. 19B shows an overhead view of an example four square cube freezing cavity configuration without water with two example inserts in accordance with the principals of the present invention.
Figure 19C:
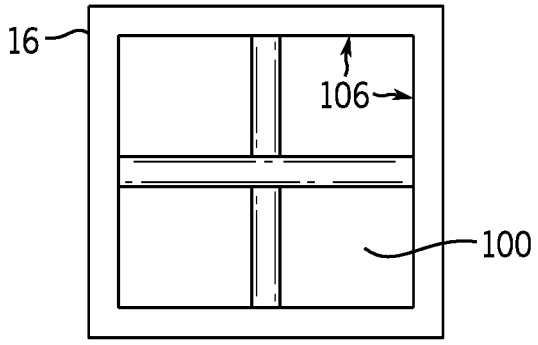
FIG. 19C shows an overhead view of an example four square cube freezing cavity configuration without water with a single insert in accordance with the principals of the present invention.

FIG. 18C shows a single insert 100 for multiple tray cavities. This insert 100 can contour to the inner geometry creating surfaces of the cavity 40 and/or tray 16, as long as one or more edges are exposed. The FIG. 18C embodiment corresponds to the FIG. 16 perspective view. As shown in FIG. 19B, an insert 100 that would span two cavities would expose three edges 106 per cavity while shown in FIG. 19C, an insert 100 that would span four cavities would expose two edges 106 per cavity. The advantages to this design include that it is easy to remove from tray and to remove ice, the insert is difficult to lose track of, and the insert is quicker to install. Possible disadvantages might include that it is a more complex design and less edges exposed could yield higher likelihood of cloudy ice above the insert.

Figure 19D:
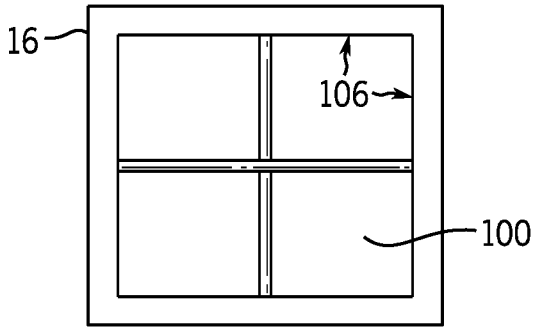
FIG. 19D shows an overhead view of an example single square cube freezing cavity configuration without water with a single solid insert further defining four square cube freezing cavities in accordance with the principals of the present invention.

Similar to FIG. 18C, FIG. 18D and FIG. 18E show a single insert 100, but instead of contouring to all the inner geometry creating surfaces, the insert 100 itself creates the inner geometry surface. In this embodiment, the cross beam of the insert 100 can be hollow as seen in FIG. 18D allowing water to fill the void space or have no void space as seen in FIG. 18E. As seen in FIG. 19D, the same number of edges 106 would be exposed as the embodiments described in FIG. 18 C. The advantages to this design include that it is easy to remove from tray, difficult to lose track of, and quicker to install. Possible disadvantages might include that it is a more complex design, difficult to remove ice from insert, and less edges exposed could yield higher likelihood of cloudy ice above the insert.

Figure 19E:
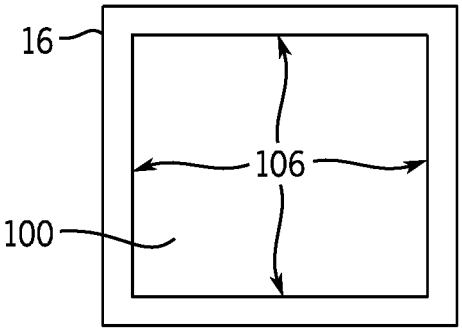
FIG. 19E shows an overhead view of an example single square cube freezing cavity configuration without water with a single insert in accordance with the principals of the present invention.

FIG. 18 F shows a single insert 100 in a single cavity in a single tray 16. As shown in FIG. 19E, an insert 100 that would span a single cavity would expose four edges 106. The advantages to this design include that it is easy to remove from tray, difficult to lose track of, quicker to install, and easy to manufacture. Possible disadvantages might include that it is difficult to remove ice from insert and if the XY cross section is too large that can lead to some cloudiness near the center. To address this last potential disadvantage, additional low flow, high energy transfer sections may need to be added to this insert. This could include small holes in the insert or multi-material insert with varying thermal conductivity.

Figure 19F:
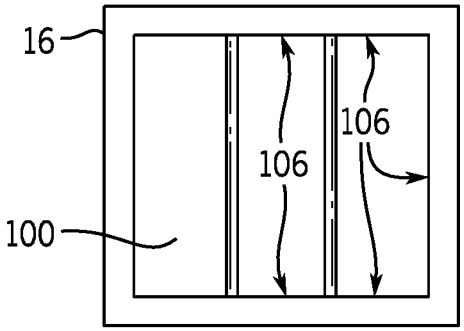
FIG. 19F shows an overhead view of an example single square cube freezing cavity configuration without water with a single insert further defining three rectangular cube freezing cavities in accordance with the principals of the present invention.

It may be advantageous from a product perspective to introduce new trays with different internal cavity dimensions. This could include ones like the Collins tray, big cube, cublets, etc. FIG. 18G shows a tray 16 for three rectangular ice forms (Collins cubes). Using one insert 100 for all three cavities would yield only two exposed edges 106 on the center cube and three exposed edges 106 on the outer cubes, as shown in FIG. 19F. Different internal geometries of the tray and/or cavities could require different configurations of inserts relative to those proposed for the four-cube tray.

Theoretically, the system may only need one point of nucleation/seeding. The present invention tries to balance the creation of perfectly clear ice within a reasonable amount of time. This would ultimately drive for more seeding locations. This is a delicate balance, however. Seed locations generally leave some small abnormalities/roughness at the interface with the clear ice. The more locations, the higher likelihood of this occurring. The present embodiment just relegates to the edges and they easily break away. This works well right now for small XY cross section (for example, two to three inches) but may require additional tuning (process or insert design) if the cross section increases substantially. If the seed does not complete the first layer above the insert before supercooling happens, cloudy ice may be formed.

It has also been discovered that with removeable inserts, air bubbles can get stuck underneath the insert during installation. It has been shown that not removing these air bubbles from below the inserts can lead to a higher likelihood of cloudy ice above the insert. Air bubbles underneath can also hinder the rate of ice growth as the thermal properties of air are much lower than ice or water. To mitigate this issue with the removeable inserts, the user can be instructed to install the inserts, fill the tray with water, then gently tap on the top of the insert with a blunt object to remove any excess bubbles.

POSSIBLE FUTURE EMBODIMENTS/IMPROVEMENTS

In addition to the process considerations in designing ice machines in accordance with the principals of the present invention, implementations can employ additional elements and improvements. For example, a water reservoir could be integrated into the ice machine but removeable by the user. The user could fill up this reservoir and install in the ice machine. Then the ice machine could pump and/or direct water from the reservoir into the tray. This could help reduce process variability, allowing for a consistent fill each time with no need for water sensing or intervention by the user.

The output of a process of the present invention is not only clear ice, but also water concentrated with impurities (TDS and TDG) that must be purged. In the exemplary embodiment described herein, the user must take the tray and dump out the water to retrieve their ice. Alternatively, the ice machine could automatically remove the water from the tray at the end of the ice generation cycle and store in a separate compartment that is integrated with the ice machine but removeable by the user. Once full or on an intermittent basis, the user could remove the compartment and discard the water. The purge water could also be filtered and potentially recycled back into the water reservoir.

Semi/automated ice ejection by the ice machine could enhance the user experience by eliminating the need for the user to remove the cubes from the tray. In one example, pins could push the ice out of the mold. In another example, the bottom and sides of the ice form could be slightly melted. Since the density of ice is less than water, the cubes would float to the top and either be retrieved by the user or carried away by the ice machine and put into storage. Another example could be a suction cup hand that pulls the ice cube out from the top.

Another feature that could be added is filtering capabilities. This could be something like a simple carbon filter that is in line with the water reservoir. This would create a more consistent starting concentration of TDS and/or TDG. An ultraviolet (UV) light could also be used to filter water before or during the ice generation cycle. This filter could also be placed in line with a purge reservoir, potentially allowing water to be reused in future ice generation cycles.

It may be advantageous to have means to store the ice in a more controlled environment than the typical consumer freezer. This could be done using a standalone freezer or unit that could be integrated with the ice making machine and/or cooling components. A special storage container could also be developed that insulates the ice from the very cold temperatures of a consumer freezer. Ultimately this could lead to ice being more readily available for the user. If held at too cold of a temperature, the ice can crack/fracture if liquid is immediately poured over the ice. The user can counter this by tempering or waiting for the ice to acclimate to room temperature before pouring their drink, which can be inconvenient.

Another potential implementation could be the addition of a hot press to either imprint different logos onto the face of the ice or take the ice and form it into another shape. This could be a stand-alone unit or could be integrated into the ice machine and/or utilize the hot air or TEC elements to produce sufficient heat to heat up a metal surface and/or melt the ice. In another implementation, a special tray/mold could be inserted into the freezing/mixing chamber of the ice machine. In this case, the polarity of the TECs could be changed and the chamber could become hot, heating up the mold/tray. The mold/tray could have features that could help capture melted ice and allow insertion and removal into the ice machine. For example, after a cube was made, one part of a two-part mold with a negative spherical feature could be placed into the freezing/heating chamber of the ice machine. The cube could be placed on top of one half then the other half could be placed on top of the cube. Over time the cube could get converted into a sphere. Another implementation could be a separate or integrated post processing machine. This post processing machine/mechanism could shape a larger ice form or enable other customization options to the user.

Ice machines in accordance with the principals of the present invention should not be limited by the type of liquid in the ice machine. The user may be able to add their own flavorings or future iterations may have consumable pods or reservoirs that could dose in flavors. Coffee, juices or other liquids could also theoretically be frozen in a similar manner from a liquid into an ice-like solid form. The tray could also be outfitted with a radiofrequency identification (RFID) tag or something similar to communicate to the ice machine presence and/or the type/shape of tray and/or type of liquid and/or other pertinent information. The tray could also be a consumable; instead of a reusable tray the user could use a new tray before every ice generation cycle.

While the invention has been described with specific embodiments, other alternatives, modifications, and variations will be apparent to those skilled in the art. Accordingly, it will be intended to include all such alternatives, modifications and variations set forth within the spirit and scope of the appended claims.

The invention claimed is:

1. An insert adapted to be used in a freezing chamber of an ice machine, the insert comprising a surface configured to trap volume of liquid between the insert and a heat exchanger of the ice machine, the volume of liquid providing a nucleation site.

2. A removable tray adapted for insertion into a freezing chamber of an ice machine, the tray adapted to receive a liquid and comprising:

a lower wall of the tray defining an energy transfer surface adapted to be in thermal contact with a heat exchanger of the ice machine;

at least one freezing cavity of the tray having geometry defining surfaces extending upwardly from the lower wall of the tray to form the geometry of ice, the at least one freezing cavity incorporating the lower wall of the tray;

at least one insert, each insert adapted to reside in the at least one freezing cavity at the lower wall, the at least one insert trapping a volume of the liquid between the at least one insert and the lower wall, the volume of the liquid providing a nucleation site; and at least one egress area contained above the at least one freezing cavity, the at least one egress area receiving a mixing mechanism to contact the liquid in the at least one egress area to create a velocity profile at a boundary layer, thereby creating a directional freezing process starting from the volume of the liquid and growing up through the at least one freeing cavity up to the at least one egress area, which deters impurities from getting entrapped in the ice.

3. The tray of claim 2 further wherein the nucleation site is defined at an edge of the edges of the at least one insert.

4. The tray of claim 2 wherein the at least one insert is a single insert for each freezing cavity of the at least one freezing cavity.

5. The tray of claim 2 wherein the at least one insert is a single insert for multiple freezing cavities of the at least one freezing cavity.

6. The tray of claim 2 wherein the at least one insert is a single insert creating multiple freezing cavities of the at least one freezing cavity, the insert having a hollow cross beam.

7. The tray of claim 2 wherein the at least one insert is a single insert creating multiple freezing cavities of the at least one freezing cavity, the insert having a solid cross beam.

8. The tray of claim 2 further comprising multiple freezing cavities of the at least one freezing cavity, with at least two of the multiple freezing cavities having different numbers of edges or aspect ratios.

9. The tray of claim 2 further wherein the insert includes a pedestal with an outwardly projecting lip defining a stagnate liquid area.

10. The tray of claim 2 further wherein the insert includes low flow, high energy transfer sections.

11. The tray of claim 2 further wherein the insert is comprised of PolyEthylene Terephthalate (PET).

12. The tray of claim 2 further wherein the insert has a thickness of about 0.1 mm to about 2 mm.

13. The tray of claim 2 having a plurality of the at least one freezing cavity, wherein the at least one egress area is formed above the plurality of freezing cavities.

14. The tray of claim 2 further wherein the energy transfer surface is selected from the group consisting of a low thermal conductivity material, a high conductivity material, and combinations thereof.

15. The tray of claim 2 further wherein each of the at least one freezing cavity and its geometry defining surfaces together form a cube shape, a cylindrical shape, or a rectangular shape.

16. The tray of claim 2 having a plurality of the at least one freezing cavity, wherein the geometry defining surfaces are shared by at least two of the plurality of freezing cavities.

17. The tray of claim 2 further wherein the geometry defining surfaces and the energy transferring surface coincide.

18. The tray of claim 2 further comprising a fill line in the egress area.

19. The tray of claim 2 further wherein the egress area width is expanded relative to the freezing cavity width.

20. The tray of claim 2 further wherein the tray further defines a notch defined in the freezing cavities at the bottom to aid in ice removal.

21. The tray of claim 2 further wherein the geometry defining surfaces of the freezing cavity provide a draft.

* * * * *